US012569107B1

(12) United States Patent
Chen

(10) Patent No.: US 12,569,107 B1
(45) Date of Patent: Mar. 10, 2026

(54) WASHING DEVICE

(71) Applicant: Foshan Dearfrog Mother and Baby Products Co., Ltd., Foshan (CN)

(72) Inventor: Yi Chen, Chongqing (CN)

(73) Assignee: Foshan Dearfrog Mother and Baby Products Co., Ltd., Foshan (CN)

( * ) Notice: Subject to any disclaimer, the term of this patent is extended or adjusted under 35 U.S.C. 154(b) by 0 days.

(21) Appl. No.: 19/297,429

(22) Filed: Aug. 12, 2025

(51) Int. Cl.
*A47L 15/00* (2006.01)
*A47L 15/48* (2006.01)
*A47L 15/50* (2006.01)

(52) U.S. Cl.
CPC ..... *A47L 15/0073* (2013.01); *A47L 15/505* (2013.01); *A47L 15/486* (2013.01); *A47L 15/488* (2013.01)

(58) Field of Classification Search
None
See application file for complete search history.

(56) References Cited

U.S. PATENT DOCUMENTS 2,271,118 A * 1/1942 Caruolo ..... A47L 15/0065 134/53
3,044,092 A * 7/1962 Fox ..... A47L 15/4418 134/103.2
5,518,014 A * 5/1996 McEachen ..... A47L 15/4225 134/107
2023/0414059 A1* 12/2023 Disch ..... A47L 15/0089

FOREIGN PATENT DOCUMENTS

CN 110777504 A 2/2020
CN 214125181 U 9/2021
CN 218509817 U 2/2023

* cited by examiner

*Primary Examiner* — Rita P Adhlakha
(74) *Attorney, Agent, or Firm* — Nitin Kaushik

(57) ABSTRACT

A washing device includes a main machine; an inner container assembly which is arranged on the main machine and provided with a washing cavity, the inner container assembly being provided with a liquid outlet hole and a backflow opening which communicate with the washing cavity, bottom wall of the washing cavity inclining relative to horizontal direction, the backflow opening being in the side with lower height of the bottom wall of the washing cavity, and horizontal height of the liquid outlet hole being greater than that of the backflow opening; and a washing module including a water pump and a circulation pipeline, an input end of the water pump communicating with the backflow opening by the circulation pipeline while an output end thereof communicating with the washing cavity through the liquid outlet hole so as to spray cleaning water to a part to be washed in the washing cavity.

12 Claims, 14 Drawing Sheets

WASHING DEVICE

TECHNICAL FIELD

The present invention relates to the technical field of household appliances, and particularly relates to a washing device.

BACKGROUND

Feeding bottle washers, as cleaning equipment for infant products, are commonly used for deeply washing and disinfecting feeding bottles by spray rinsing, high-temperature steam sterilization, or ultrasonic cavitation cleaning in existing technologies. The spray type feeding bottle washer sprays water with a high-pressure spray arm to mechanically flush inner and outer walls of the feeding bottle, and in combination with high-temperature disinfection functions, it has become the mainstream equipment for cleaning the infant products. However, existing spray type washers have a serious problem of water resource waste during operation.

SUMMARY

Based on this, it is necessary to provide a washing device to solve the problem that an existing spray type washer has a serious problem of water resource waste during operation.

The washing device includes a main machine; an inner container assembly which is arranged on the main machine and provided with a washing cavity, the inner container assembly being provided with liquid outlet holes and a backflow opening which communicate with the washing cavity, the bottom wall of the washing cavity inclining relative to the horizontal direction, the backflow opening being located in the side with lower height of the bottom wall of the washing cavity, and the horizontal height of the liquid outlet holes being greater than that of the backflow opening; and a washing module which comprises a water pump and a circulation pipeline, an input end of the water pump communicating with the backflow opening by the circulation pipeline while an output end thereof communicating with the washing cavity through the liquid outlet holes so as to spray cleaning water to a part to be washed in the washing cavity.

The present application provides a washing device; the washing cavity of the inner container assembly communicates with the output end and the input end of the water pump through the liquid outlet holes and the backflow opening thereof in a one-to-one manner, and therefore, after being outputted by the water pump is sprayed through the liquid outlet hole to flush to the part to be washed in the washing cavity, cleaning water can fall by gravity and then flows back into the water pump through the backflow opening so as to be recycled, thereby effectively decreasing the consumption of the cleaning water; moreover, the bottom wall of the washing cavity inclines relative to the horizontal direction, and the backflow opening is distributed in the side with the lower height of the bottom wall of the washing cavity, which accelerates to drain liquid from the washing cavity; the lower the position of the backflow opening is, the higher the possibility that the liquid automatically flows back to a system by gravity is, which can reduce the dependence on the water pump, thereby reducing the energy consumption; it is also conducive to completely drain the liquid from the washing cavity, thus avoiding bacterium breeding caused by retained water, and making the device more sanitary and reliable; and in addition, compared with a traditional flat-bottom inner container, the area of cross section of the bottom of the inner container assembly in this solution gradually decreases in the direction close to the backflow opening, which can effectively reduce the backflow starting flow rate, and be conducive to decreasing water consumption of the washing device.

In one of the embodiments, further comprising: a support assembly which used for limiting the part to be washed, the inner container assembly and the support assembly are obliquely arranged in the main machine in the same direction; the liquid outlet holes are located in the bottom wall of the inner container assembly, and an included angle between the central axes of the liquid outlet holes and the vertical direction is an acute angle. The support assembly can be used for limiting and fixing the part to be washed, which ensures that the part to be washed can be better arranged on a washing station, and prevents the part to be washed from being turned over by high-pressure water to influence the cleaning effect; and by means of this structure, the cleaning water sprayed through the liquid outlet hole collides with the part to be washed and then falls onto the wall surface of the part to be washed by gravity, thus stains on the part to be washed can be better flushed, and the cleaning effect is improved. Specifically, the support assembly can bear a plurality of parts to be washed.

In one of the embodiments, the included angle between the central axes of the liquid outlet holes and the vertical direction is a, and a meets: $20° \leq a \leq 25°$.

In one of the embodiments, the main machine is provided with a first mounting cavity having a top opening, the included angle between the central axis of the top opening and the vertical direction is an acute angle, the inner container assembly is detachably arranged in the first mounting cavity, and a flange is formed on the top of the inner container assembly and used for abutting against the end surface of the top opening. By means of this structure, on one hand, the inner container assembly can be rapidly and conveniently assembled on and disassembled from the main machine, and on the other hand, the top opening is obliquely formed in the main machine, so that when the inner container assembly abuts against the end surface of the top opening by the flange, the inclined arrangement of the inner container assembly can be achieved, and the structure is simple.

In one of the embodiments, further comprising the support assembly and a rotating mechanism, the support assembly is movably arranged in the washing cavity and is used for limiting the part to be washed, the output end of the rotating mechanism is in driving connection with the support assembly, and the support assembly is configured to drive the part to be washed to rotate relative to the inner container assembly under the driving of the rotating mechanism. The rotating mechanism is arranged to drive the support assembly to rotate, and during use, after the plurality of parts to be washed are placed on the support assembly to be fixed, the rotating mechanism can drive the support assembly and the part to be washed to rotate relative to the inner container assembly, thus each part to be washed passing through the liquid outlet holes can be sequentially sprayed and cleaned by the cleaning water sprayed through the liquid outlet holes, and a waterway structure of the device is simplified while it is guaranteed that all the parts to be washed are fully and effectively cleaned.

In one of the embodiments, the support assembly includes a supporting seat and a limiting support; the supporting seat is detachably connected to the output end of the rotating mechanism and is used for supporting the part to be washed;

and the limiting support is detachably arranged on the supporting seat and is used for limiting and fixing the end, away from the supporting seat, of the part to be washed. By means of this structure, the support assembly is composed of the supporting seat and the limiting support which are detachably connected, when a user disassembles the support assembly for cleaning the washing device, the support assembly can be further disassembled, thus food residues at dead corners of the support assembly can be removed conveniently, and dirt accumulation is reduced.

In one of the embodiments, the washing device further includes a sensor assembly which is used for acquiring the rotating position information of the support assembly so as to support the rotating mechanism to control the positioning rotation of the support assembly. The sensor assembly is used for collecting the rotating position information of the support assembly, and the rotating mechanism can flexibly adjust the position of each station on the support assembly relative to the inner container assembly according to the position information, so that the time for adjusting different positions to correspond to the liquid outlet holes for cleaning operation according to the cleaning requirements of different parts to be washed.

In one of the embodiments, the bottom wall of the washing cavity protrudes to form a mounting portion, and the mounting portion is provided with a first mounting hole communicating with the washing cavity; and the rotating mechanism is arranged in the main machine, and the output end of the rotating mechanism extends into the washing cavity through the first mounting hole to be detachably connected to the support assembly. By means of this structure, the support assembly is detachably connected to the output end of the rotating mechanism, and therefore when cleaning the washing device, the user can easily disassemble the support assembly to fully expose the dead corners in the device, which greatly improves the cleaning effect and the cleaning efficiency; and in addition, the protruded mounting portion is provided with the first mounting hole used for penetrating through the output end of the rotating mechanism, thus reducing the risk of water entering the first mounting hole, and ensuring the use safety of the rotating mechanism.

In one of the embodiments, the rotating mechanism comprises a driving motor, a transmission shaft and a shaft sleeve; the shaft sleeve is located in the washing cavity and is rotatably arranged on the mounting portion; one end of the transmission shaft penetrates through the first mounting hole to be mounted adaptive to the shaft sleeve, the driving motor is in transmission connection with the other end of the transmission shaft to drive the transmission shaft and the shaft sleeve to rotate relative to the inner container assembly; and the support assembly is detachably arranged on the shaft sleeve. By means of this structure, the transmission shaft is in transmission connection with the support assembly by the shaft sleeve, and in combination with the connection between the shaft sleeve and the mounting portion, the mounting portion can directly provide a supporting effect for the support assembly, which ensures that the part to be washed can be driven by the rotation of the support assembly to stably rotate relative to the inner container assembly and the liquid outlet hole so as to be fully sprayed and cleaned; and in addition, through the connection between the shaft sleeve and the mounting portion, the splashed liquid in the washing cavity can be prevented from leaking through a gap between a transmission rod and the inner wall of the first mounting hole to damage the driving motor.

In one of the embodiments, an inserting groove is formed in one of the support assembly and the shaft sleeve, and the other one of the support assembly and the shaft sleeve is adaptively inserted into the inserting groove. By means of this structure, the support assembly and the shaft sleeve can be quickly assembled without screws, nuts and other accessories, which greatly facilitates the user to conveniently disassemble the support assembly for cleaning the washing device in all directions.

In one of the embodiments, a key groove is formed in the inner wall of the inserting groove, and the support assembly or the shaft sleeve is provided with a clamping key which is mounted adaptive to the key groove. By means of this structure, the support assembly and the shaft sleeve are assembled in an inserted mode by the inserting groove, and in combination with the adaptive mounting of the clamping key and the key groove, the support assembly and the shaft sleeve can be further interlocked, so that the shaft sleeve can accurately transmit torque to the support assembly to achieve synchronous rotation, and the support assembly is prevented from rotating automatically to influence positioning rotation of the user on the support assembly.

In one of the embodiments, the support assembly is provided with the inserting groove, an annular sealing portion is arranged on the peripheral wall of the end, away from the shaft sleeve, of the mounting portion, and the annular sealing portion is mounted adaptive to an opening of the inserting groove. By means of the above structure, after the support assembly and the shaft sleeve are assembled in the inserted mode by the inserting groove, the annular sealing portion on the mounting portion can be used for sealing the opening of the inserting groove in a fitting mode, and therefore the liquid in the washing cavity can be prevented from entering the inserting groove and can also be prevented from splashing and flowing into a connecting gap between the mounting portion and the shaft sleeve and/or the transmission shaft to cause leakage.

In one of the embodiments, the shaft sleeve is provided with a second mounting hole, and the end, away from the driving motor, of the mounting portion is mounted adaptive to the second mounting hole. By means of the above structure, after the mounting portion enters the second mounting hole and is connected to the inner wall of the second mounting hole, the liquid splashing in the washing cavity can be prevented from directly passing through the gap between the transmission rod and the inner wall of the first mounting hole to cause leaking.

In one of the embodiments, a limiting step is formed on the inner wall of one end, far away from the motor, of the second mounting hole, and the top wall of the mounting portion is propped against the limiting step. By means of this structure, the top wall of the mounting portion is propped against the limiting step to limit and support the shaft sleeve, so that the shaft sleeve can be stably mounted, and the support assembly is prevented from driving the shaft sleeve to downwards slip to influence the rotation of a rotary support while bearing a heavy part to be washed.

In one of the embodiments, the radial length of the second mounting hole gradually decreases in the direction far away from the motor. The tapered second mounting hole can be matched with the adaptive mounting portion to achieve the limiting effect; and when the support assembly bears the heavy part to be washed, the shaft sleeve can be stably mounted without downward slipping.

In one of the embodiments, further comprising the support assembly and an air supply module, in which a first air inlet communicating with the washing cavity is formed in the bottom wall of the inner container assembly, and the horizontal height of the first air inlet is greater than that of the backflow opening; the support assembly is arranged in the washing cavity and located above the first air inlet; the air supply module comprises an air duct shell and a fan assembly; the air duct shell is arranged on the outer side of the inner container assembly and is provided with an air supply channel communicating with the washing cavity; at least part of the fan assembly is located in the air supply channel; and the fan assembly is used for driving outside air to enter the air supply channel and then to enter the washing cavity through the first air inlet. The first air inlet is further formed in the bottom wall of the inclined inner container assembly and used for inputting airflow; the horizontal height of the first air inlet is set to be greater than that of the backflow opening, and therefore, in the washing process, the cleaning water in the washing cavity preferentially flows back to the water pump through the backflow opening, thus reducing the possibility of the cleaning water entering the air supply channel. After washing, the washed devices such as a feeding bottle are inverted on the support assembly which is of a hollow structure, a bottle opening of the feeding bottle is downward and is opposite to the first air inlet, then the fan assembly drives the outside air to flow through the air supply channel of the air duct shell and then to enter the washing cavity by the first air inlet, and further the outside air enters the feeding bottle through the bottle opening to drive to quickly exhaust damp and hot air, and therefore the drying effect of the washing device is improved.

In one of the embodiments, the inner container assembly is provided with a second air inlet which communicates with the washing cavity and the air outlet end of the air supply channel, and the fan assembly is used for driving outside air to enter the air supply channel and then to enter the washing cavity through the second air inlet. By means of this structure, the airflow entering the washing cavity through the second air inlet takes away water vapor on the inner wall of the washing cavity and the outer surface of the part to be washed, thereby ensuring that the inner wall of the washing cavity and objects in the cavity are fully dried.

In one of the embodiments, the second air inlet is located in the side wall of the inner container assembly.

In one of the embodiments, the backflow opening communicates with the air outlet end of the air supply channel, and the fan assembly is used for driving outside air to enter the air supply channel and then to enter the washing cavity and the washing module through the backflow opening. By means of this structure, on one hand, the airflow flowing to the backflow opening from the air supply channel enters the washing cavity to take away the water vapor on the inner wall of the washing cavity and the outer surface of the part to be washed, and on the other hand, the airflow enters the washing module at the same time to dry the water pump, the inner wall of a pipeline and the like, thereby avoiding the hygiene risk of bacteria breeding caused by long-term prolonged dampness of the water pump and the pipeline, and being conducive to more durable use.

In one of the embodiments, a flow guide portion is formed at the bottom of the inner container assembly; the flow guide portion is provided with a first liquid passing cavity which communicates with the washing cavity through the backflow opening; a first liquid passing opening and a second liquid passing opening which communicate with the first liquid passing cavity are formed in two sides of the flow guide portion, respectively; the first liquid passing opening communicates with the water pump; and the second liquid passing opening communicates with the output end of the air supply channel, and the horizontal height of the second liquid passing opening is greater than that of the first liquid passing opening. By means of this structure, because the horizontal height of the second liquid passing opening is greater than that of the first liquid passing opening, after the cleaning water in the washing cavity enters the first liquid passing cavity through the backflow opening, the cleaning water will preferentially enter the water pump or the wastewater tank from the first liquid passing opening at the lower position, and therefore the possibility of the cleaning water entering the air supply channel can be reduced.

In one of the embodiments, the air supply channel comprises a second mounting cavity, an air gap and an air guide cavity which sequentially communicate; an air outlet end of the air guide cavity communicates with the washing cavity through the first air inlet; at least part of the fan assembly is arranged in the second mounting cavity; and a water collecting tank is arranged at the bottom of the air guide cavity, and is located between the air gap and the air outlet end of the air guide cavity. By means of this structure, after the cleaning water in the washing cavity enters the air guide cavity through the first air inlet and/or the backflow opening, the water collecting tank can intercept to collect the cleaning water, thus avoiding the cleaning water further flowing to the air gap to enter the second mounting cavity to damage electric appliance elements such as the fan assembly.

In one of the embodiments, the air outlet end of the air guide cavity includes a first air outlet and a second air outlet; the first air outlet communicates with the first air inlet; and the second air outlet communicates with the backflow opening or the second air inlet.

In one of the embodiments, a water outlet is formed in the bottom of the water collecting tank and communicates with a drain outlet of the washing module/the main machine by the pipeline. By means of this structure, the liquid in the water collecting tank can be conveniently drained through the drain outlet in time, which avoids that too much cleaning water collected by the water collecting tank overflows and flows to the air passing port, and is conducive to reducing the size of the water collecting tank, thereby making the structure of the air supply module more compact. Specifically, the water outlet can be in communication with the water pump through the pipeline for recycling again, or in communication with the wastewater tank through the pipeline for collecting in a centralized mode, or directly in communication with the drain outlet of the host for draining to the outside.

In one of the embodiments, a water baffle is arranged on the bottom wall of the air guide cavity and is located between the water collecting tank and the air outlet end of the air guide cavity. After the cleaning water in the washing cavity enters the air guide cavity through the first air inlet and/or the backflow opening, the water baffle can block and buffer the cleaning water, thereby reducing the flowing speed of the cleaning water and avoiding the cleaning water splashing to cause spray flying to the air passing port; and along with increase of the cleaning water in the air guide cavity, the cleaning water flows over the water baffle to fall into the water collecting tank.

In one of the embodiments, the air duct shell comprises a first shell and a second shell; a mounting opening is formed in the top wall of the first shell; a connecting portion which is mounted adaptive to the mounting opening is formed on the second shell; a second mounting cavity is defined by the connecting portion and the inner wall of the first shell; the air guide cavity is arranged in the second shell; the air gap is formed in the connecting portion. The second mounting cavity is defined by the first shell and the second shell which are detachably connected, which facilitates to expose the second mounting cavity for production personnel to assemble and disassemble electrical apparatus elements such as a heating assembly, thereby facilitating repair and maintenance of the air supply module. In addition, the first shell and the second shell are respectively provided with the mounting opening and the connecting portion which fit each other; and in combination with the cooperation of the mounting port and the connecting portion, the first shell and the second shell can be tightly connected, and thus air entering the second mounting cavity can fully enter the air guide cavity to avoid leakage.

In one of the embodiments, the water collecting tank is located at the connecting portion; a drain pipe is arranged on the side, facing the first shell, of the connecting portion; a limiting hole is formed in the bottom wall of the first shell; one end of the drain pipe communicates with the water collecting tank while the other end thereof penetrates through the limiting hole to extend to the outside of the second mounting cavity and communicates with the drain outlet of the washing module/main machine. By means of this structure, on one hand, the liquid in the water collecting tank can be conveniently drained in time by the drain pipe, and on the other hand, the drain pipe passes through the second mounting cavity and the limiting hole to extend to the outside, which reduces the exposure of the drain pipe and makes the structure of the air duct shell more compact and simpler; and moreover, the drain pipe and the limiting hole can be matched to realize a limiting effect, so that the second shell can be more easily located on the first shell, which makes the mounting more stable.

In one of the embodiments, the air supply module further comprises a heating assembly which is arranged in the second mounting cavity and is used for heating air entering the air supply channel. After the air in the air supply channel is heated by the heating assembly, the drying efficiency of the washing device can be greatly improved, and a certain sterilization and disinfection effect can be achieved.

In one of the embodiments, a first mounting groove is formed in the side, facing the second mounting cavity, of the connecting portion; the air gap is formed in the bottom wall of the first mounting groove; and the heating assembly is mounted adaptive to the first mounting groove. By means of this structure, the first mounting groove facilitates positioning and mounting of the heating assembly, thus improving the mounting efficiency; and moreover, when the air in the second mounting cavity flows to the air guide cavity through the air gap, it can be ensured that the air can make full contact with the heating assembly, thereby improving the heating efficiency.

In one of the embodiments, the side, away from the first shell, of the second shell is connected to the outer bottom wall of an inner container, and the second shell is provided with a first air outlet and a second air outlet.

In one of the embodiments, the air supply module further comprises a rotary valve which is rotatably arranged in the air duct shell and has at least an on position and an off position; when the rotary valve is at the on position, the air gap is opened to connect the air supply channel; when the rotary valve is at the off position, the air gap is closed to disconnect the air supply channel; and the rotary valve can be pushed by the airflow generated by the fan assembly so as to be switched to the on position from the off position. The rotary valve is arranged in the air duct and used for opening or closing the air gap, and the rotary valve is rotatably connected to the air duct shell; the airflow generated by the fan assembly in working can blow open the rotary valve, so as to connect the air supply channel; when the fan assembly is closed, the airflow disappears, the rotary valve resets by gravity to block the airflow channel, and at the moment, the rotary valve can perform a blocking effect to further prevent the cleaning water in the washing cavity from entering the air guide cavity to collide with the inner wall of the air guide cavity and generate water spray flying to the air gap, as well as preventing the cleaning water from entering the second mounting cavity to damage electrical apparatus elements such as the heating assembly.

In one of the embodiments, when the rotary valve is at the off position, one end of the rotary valve is rotatably connected to the air duct shell, and the other end of the rotary valve inclines downwards and extends to be above the water collecting tank. By means of this structure, the rotary valve is in an inclined state when at the off position, and therefore the cleaning water splashing onto the rotary valve can slide into the water collecting tank along the top wall of the rotary valve by gravity.

In one of the embodiments, the second shell includes a shell body and a cover body; the cover body is detachably arranged on the shell body; a shaft hole is defined by a connecting cover and the shell body; and the rotary valve is rotatably connected to the first shell through the cooperation of the rotating shaft and the shaft hole. The shaft hole is defined by the shell body and the cover body which are detachably connected, which makes the mounting of the rotary valve convenient and fast.

In one of the embodiments, the cover plate is provided with the first air outlet.

In one of the embodiments, the air guide cavity and the second air outlet are defined by the cover plate and the shell body.

In one of the embodiments, a pressurizing portion is formed at the bottom of the inner container assembly and is provided with a second liquid passing cavity; a liquid inlet hole is formed in one side of the second liquid passing cavity, and a plurality of liquid outlet holes are formed in the other side of the second liquid passing cavity; the diameter of the plurality of liquid outlet holes is smaller than that of the liquid inlet hole; and the output end of the water pump, the liquid inlet hole, the second liquid passing cavity, the plurality of liquid outlet holes and the washing cavity sequentially communicate. The pressurizing portion is formed on the inner container assembly and used for guiding high-pressure water outputted by the water pump to the washing cavity to spray to flush the part to be washed, in which, the pressurizing portion is provided with the liquid inlet hole, the second liquid passing cavity and the plurality of liquid outlet holes; and the diameter of the plurality of liquid outlet holes is smaller than that of the liquid inlet hole, so that on one hand, the water outputted by the water pump can be better guided to each liquid outlet hole by the pressurizing portion so as to increase the washing area, and on the other hand, when the high-pressure cleaning water outputted by the water pump flows to the liquid outlet holes from the liquid inlet hole to be sprayed out, the sectional area suddenly reduces, the flow speed increases, and thus the water pressure is increased; and through the cooperative use of the water pump and the pressurizing portion, the cleaning water has higher impact force to wash the surface of the part to be washed under the condition that it is not needed to increase the power of the water pump, so that the cleaning effect of the washing device is effectively guaranteed.

In one of the embodiments, each liquid outlet hole comprises a first liquid outlet hole and a plurality of second liquid outlet holes; and the plurality of second liquid outlet holes are arranged at intervals around the central axis of the first liquid outlet hole, and the diameter of the first liquid outlet hole is larger than or equal to that of the second liquid outlet holes. By means of this structure, the first liquid outlet holes can be aligned with an opening of an inner cavity of the inverted part to be washed on the support assembly, so that the cleaning water sprayed from the first liquid outlet holes can clean the inner wall of the part to be washed, and moreover, the cleaning water sprayed by the plurality of second liquid outlet holes can be matched to wash the outer peripheral wall of the part to be washed, thereby making sure that the part to be washed is fully cleaned.

In one of the embodiments, each liquid outlet hole further comprises a plurality of third liquid outlet holes which are arranged at intervals around the central axis of the first liquid outlet holes; and the plurality of third liquid outlet holes are matched with the first liquid outlet holes to spray the cleaning water to the inner wall of the part to be washed in the washing cavity. By arranging the plurality of third liquid outlet holes, the consumption and the spraying coverage area of the cleaning water entering the inner cavity of the part to be washed from the liquid outlet holes of the pressurizing portion can be increased, and therefore the washing efficiency can be further improved on the premise that the water pressure is prevented from being reduced due to the increase in the diameter of the first liquid outlet holes.

In one of the embodiments, each liquid outlet hole further comprises a plurality of fourth liquid outlet holes which are arranged at intervals around the central axis of the first liquid outlet holes; and the plurality of fourth liquid outlet holes are matched with the second liquid outlet holes to spray the cleaning water to the outer wall of the part to be washed in the washing cavity. By arranging the plurality of fourth liquid outlet holes, the consumption of the cleaning water sprayed to the outer wall of the part to be washed by the liquid outlet holes of the pressurizing portion can be increased, so that on one hand, the cleaning time can be decreased, and on the other hand, for the part to be washed with the radial size changed, the outer wall can be better covered with the cleaning water that is directly sprayed.

In one of the embodiments, the diameter of the first liquid outlet holes and/or the diameter of the second liquid outlet holes gradually increase in the direction away from the liquid inlet hole. By means of this structure, the cleaning water sprayed by the liquid outlet hole can be diffused to a certain extent so as to enlarge the spraying area.

In one of the embodiments, the diameter of the first liquid outlet holes is 7.0-9.0 mm.

In one of the embodiments, the diameter of the second liquid outlet holes is 1.0-2.0 mm.

In one of the embodiments, the diameter of the third liquid outlet hole and/or the diameter of the fourth liquid outlet holes gradually increase in the direction away from the liquid inlet hole.

In one of the embodiments, the diameter of the third liquid outlet holes and/or the diameter of the fourth liquid outlet holes are/is 1.0-2.0 mm.

In one of the embodiments, the inner container assembly comprises an inner container body and a water spray cover; the water spray cover is detachably arranged on the bottom wall of the inner container body; a second liquid passing cavity is defined by the water spray cover and the inner container body; the liquid inlet hole is formed in the bottom wall of the inner container body; and the plurality of liquid outlet holes are formed in the water spray cover. By means of the inner container body and the water spray cover which are detachably connected, the user can conveniently disassemble the water spray cover to expose the internal structure of the pressurizing portion for complete cleaning, thereby avoiding dirt accumulation and sanitation dead corners.

In one of the embodiments, a second mounting groove is formed in the bottom wall of the inner container body; the liquid inlet hole is formed in the bottom wall of the second mounting groove; a limiting groove is formed in the inner side wall of the second mounting groove and extends in the circumferential direction of the second mounting groove; a mounting ring fitting the second mounting groove is formed at the bottom of the water spray cover, a bump is arranged on the outer wall of the mounting ring; the water spray cover is movably arranged in the second mounting groove; the water spray cover is configured to be driven by external force to rotate around the central axis of the limiting groove relative to the inner container body and has at least a locking position and a releasing position; when the water spray cover is at the locking position, the bump is mounted adaptive to the limiting groove to limit the water spray cover to move upwards away from the second mounting groove; and when the water spray cover is at the releasing position, the bump is separated from the limiting groove to make the water spray cover move upwards away from the second mounting groove. The second mounting groove and the mounting ring which fit each other are formed on the bottom wall of the inner container body and the water spray cover correspondingly, on the one hand, the second mounting groove and the mounting ring are matched to realize the positioning effect, thus the mounting efficiency of the water spray cover is greatly improved, and on the other hand, the sealing connection between the water spray cover and the inner container body can be enhanced to ensure that the liquid entering the second liquid passing cavity through the liquid inlet hole can fully flow to the liquid outlet holes so as to be sprayed to the washing cavity. Moreover, the bump capable of being matched with the limiting groove in the second mounting groove is arranged on the outer wall of the mounting ring, the water spray cover can be locked and released when rotating relative to the limiting groove under operation of the user, and operation is easy, stable and reliable. Specifically, after the water spray cover is mounted in the second mounting groove, the water spray cover is rotated forwards to the locking position, the bump will be mounted adaptive to the limiting groove and the inner wall of the limiting groove abuts against the top wall of the bump, thus the water spray cover can be prevented from being separated from the limiting groove under the impact of water pressure, and it is ensured that the cleaning water can be stably sprayed; and when it is needed to disassemble the water spray cover, the water spray cover is rotated reversely to the releasing position, in addition, the bump is separated from the limiting groove, the limiting effect is achieved, and then the water spray cover can be easily taken out.

In one of the embodiments, the top wall of the water spray cover is sunken downwards to form at least two receding grooves; and the at least receding grooves are arranged at intervals around the central axis of the water spray cover and are matched for operation to drive the water spray cover to move relative to the inner container body. By means of this structure, the receding grooves can facilitate the user to stretch in with fingers, and the receding grooves can provide acting points for the user to operate, and therefore the rotating operation on the water spray cover is more flexible and convenient; and the receding grooves are sunken, so that an operating portion is prevented from protruding to influence the assembling of the support assembly.

In one of the embodiments, the washing module further comprises a wastewater tank and a blow-off pipeline; the wastewater tank is arranged on the main machine; the washing cavity or the water pump communicates with the wastewater tank by the blow-off pipeline; a switch valve is arranged on the blow-off pipeline. By means of this structure, when cleaning is finished and it is needed to drain wastewater in the washing cavity and/or the water pump, the switch valve can be opened for water draining; and the waste water is collected into the wastewater tank. It is to be noted that the switch valve is used for connecting or disconnecting the blow-off pipeline; when the switch valve is on, the blow-off pipeline is connected; and when the switch valve is off, the blow-off pipeline is disconnected.

In one of the embodiments, the washing module further comprises a clean water tank which is arranged on the main machine and is used for providing cleaning water for the washing device.

REFERENCE NUMERALS

Figure 1:
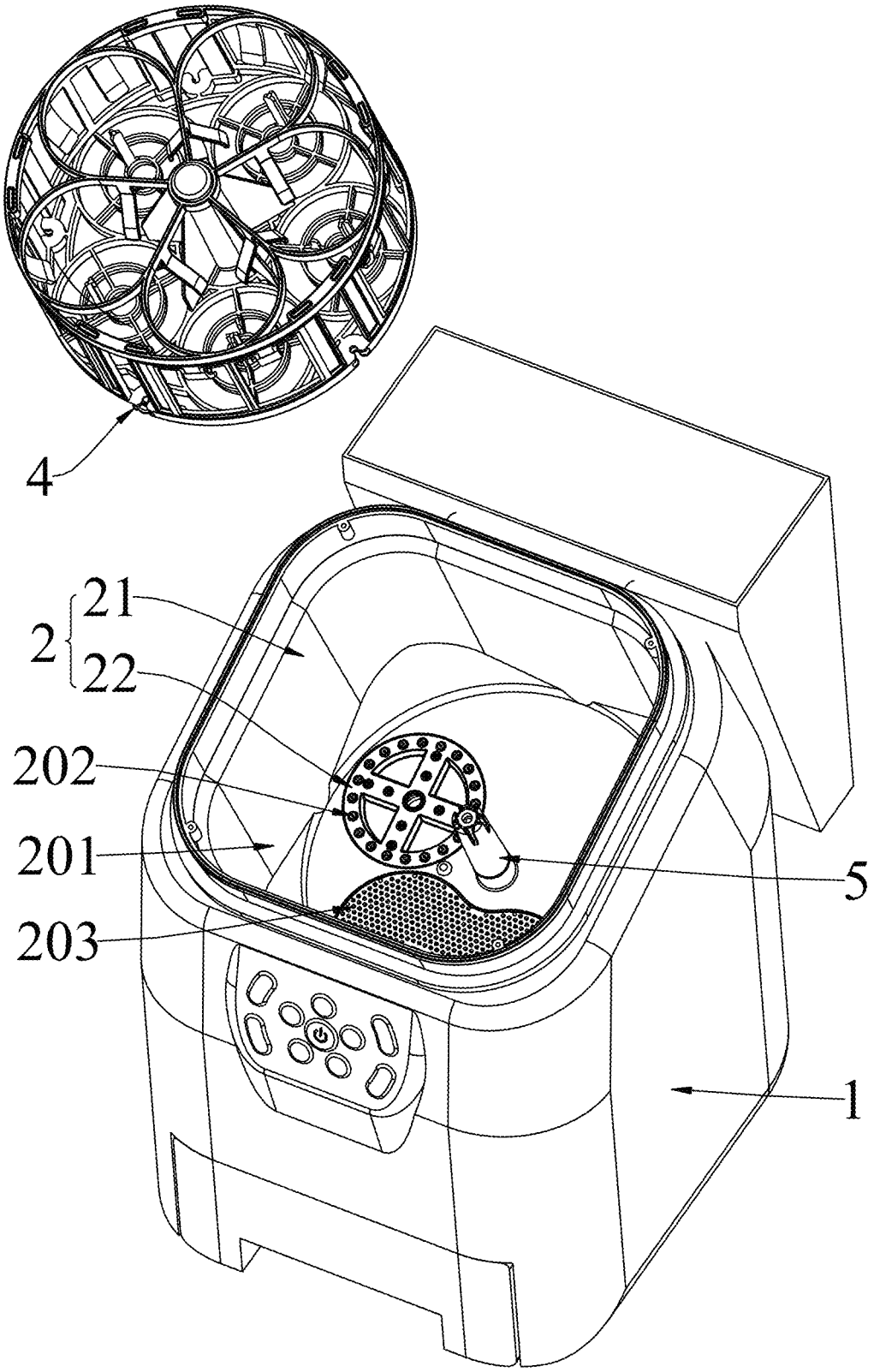
FIG. 1 is a first exploded diagram of a washing device according to an embodiment.

1, main machine; 101, top opening; 102, first mounting cavity;

2, inner container assembly; 201, washing cavity; 202, liquid outlet hole; 2021, first liquid outlet hole; 2022, second liquid outlet hole; 2023, third liquid outlet hole; 2024, fourth liquid outlet hole; 203, backflow opening; 204, first mounting hole; 205, first air inlet; 206, second liquid passing cavity; 207, liquid inlet hole; 208, second mounting groove; 209, limiting groove; 210, receding groove; 21, inner container body; 211, flange; 212, mounting portion; 213, annular sealing portion; 214, flow guide portion; 22, water spray cover; 221, mounting ring; 222, bump;

3, washing module; 31, water pump; 32, circulation pipeline; 33, wastewater tank; 34, clean water tank;

4, support assembly; 401, inserting groove; 402, key groove; 403, second mounting hole; 41, supporting seat; 42, limiting support;

5, rotating mechanism; 51, driving motor; 52, transmission shaft; 53, shaft sleeve; 531, clamping key; 532, limiting step;

6, air supply module; 601, air supply channel; 6011, second mounting cavity; 6012, air gap; 6013, air guide cavity; 6014, first air outlet hole; 6015, second air outlet; 602, water collecting tank; 603, water outlet; 604, mounting opening; 605, limiting hole; 606, first mounting groove; 61, air duct shell; 611, first shell; 612, second shell; 6121, shell body; 61211, water baffle; 61212, connecting portion; 61213, drain pipe; 6122, cover body; 62, fan assembly; 63, heating assembly; and 64, rotary valve.

DETAILED DESCRIPTION OF THE EMBODIMENTS

In order to more clearly understand the above objectives, features, and advantages of the present invention, a further detailed description of the present invention is provided below in conjunction with the accompanying drawings and specific embodiments. It is to be noted that, in the absence of conflict, the embodiments of the present application and the features of the embodiments can be combined with each other.

Many specific details are described below to fully understand the present invention; and however, the present invention can also be implemented in ways different from those described herein. Therefore, the scope of the present invention is not limited to the specific embodiments disclosed below.

The washing device in some embodiments of the present invention is described below with reference to the accompanying drawings.

As shown in FIG. 1 to FIG. 4, this embodiment discloses a washing device, which includes a main machine 1; an inner container assembly which is arranged on the main machine 1 and provided with a washing cavity 201, the inner container assembly 2 being provided with liquid outlet holes 202 and a backflow opening 203 which communicate with the washing cavity 201, the bottom wall of the washing cavity 201 inclining relative to the horizontal direction, the backflow opening 203 being located in the side with lower height of the bottom wall of the washing cavity 201, and the horizontal height of the liquid outlet holes 202 being greater than that of the backflow opening 203; and a washing module 3 including a water pump 31 and a circulation pipeline 32, an input end of the water pump 31 communicating with the backflow opening 203 by the circulation pipeline 32 while an output end thereof communicating with the washing cavity 201 through the liquid outlet holes 202 so as to spray cleaning water to a part to be washed in the washing cavity 201.

The present application provides a washing device; the washing cavity 201 of the inner container assembly 2 communicates with the output end and the input end of the water pump 31 through the liquid outlet holes 202 and the backflow opening 203 thereof in a one-to-one manner, and therefore, after being outputted by the water pump 31 is sprayed through the liquid outlet hole 202 to flush to the part to be washed in the washing cavity 201, cleaning water can fall by gravity and then flows back into the water pump 31 through the backflow opening 203 so as to be recycled, thereby effectively decreasing the consumption of the cleaning water; moreover, the bottom wall of the washing cavity 201 inclines relative to the horizontal direction, and the backflow opening 203 is distributed in the side with the lower height of the bottom wall of the washing cavity 201, which accelerates to drain liquid from the washing cavity 201; the lower the position of the backflow opening 203 is, the higher the possibility that the liquid automatically flows back to a system by gravity is, which can reduce the dependence on the water pump 31, thereby reducing the energy consumption; it is also conducive to completely drain the liquid from the washing cavity 201, thus avoiding bacterium breeding caused by retained water, and making the device more sanitary and reliable; and in addition, compared with a traditional flat-bottom inner container, the area of cross section of the bottom of the inner container assembly 2 in this solution gradually decreases in the direction close to the backflow opening 203, which can effectively reduce the backflow starting flow rate, and be conducive to decreasing water consumption of the washing device.

As shown in FIG. 1 to FIG. 5, besides the features provided by above embodiment, in this embodiment, it is further specified that the washing device also includes a support assembly 4 used for limiting the part to be washed; the inner container assembly 2 and the support assembly 4 are obliquely arranged in the main machine 1 in the same direction; the liquid outlet holes 202 are located in the bottom wall of the inner container assembly 2, and an included angle between the central axes of the liquid outlet holes 202 and the vertical direction is an acute angle. The support assembly 4 can be used for limiting and fixing the part to be washed, which ensures that the part to be washed can be better arranged on a washing station, and prevents the part to be washed from being turned over by high-pressure water to influence the cleaning effect; and by means of this structure, the cleaning water sprayed through the liquid outlet hole 202 collides with the part to be washed and then falls onto the wall surface of the part to be washed by gravity, thus stains on the part to be washed can be better flushed, and the cleaning effect is improved. Specifically, the support assembly 4 can bear a plurality of parts to be washed.

Besides the features provided by the above embodiment, in this embodiment, it is further specified that the included angle between the central axes of the liquid outlet holes 202 and the vertical direction is a, and a meets: $20° \leq a \leq 25°$.

Figure 2:
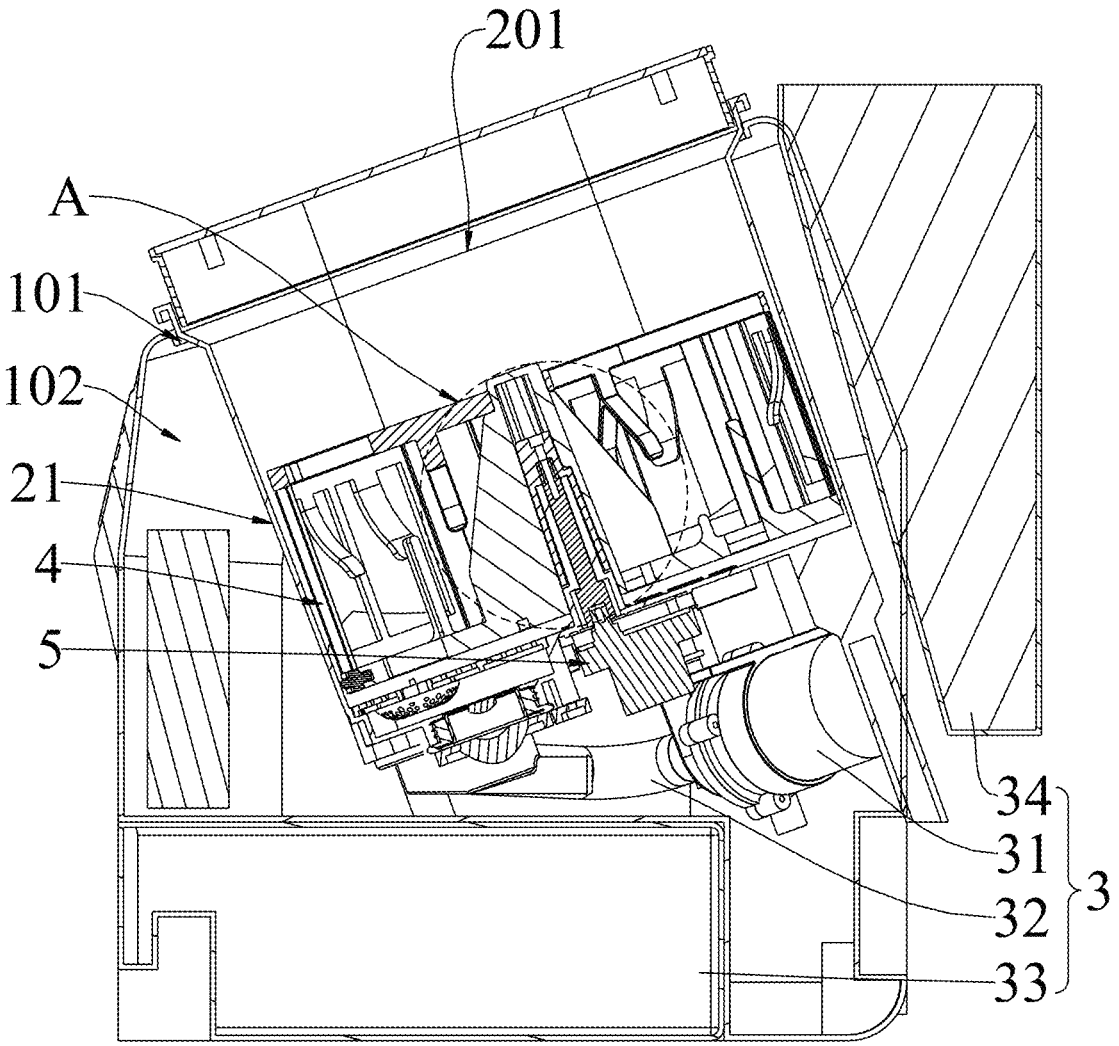
FIG. 2 is a first section diagram of a washing device according to an embodiment.
Figure 3:
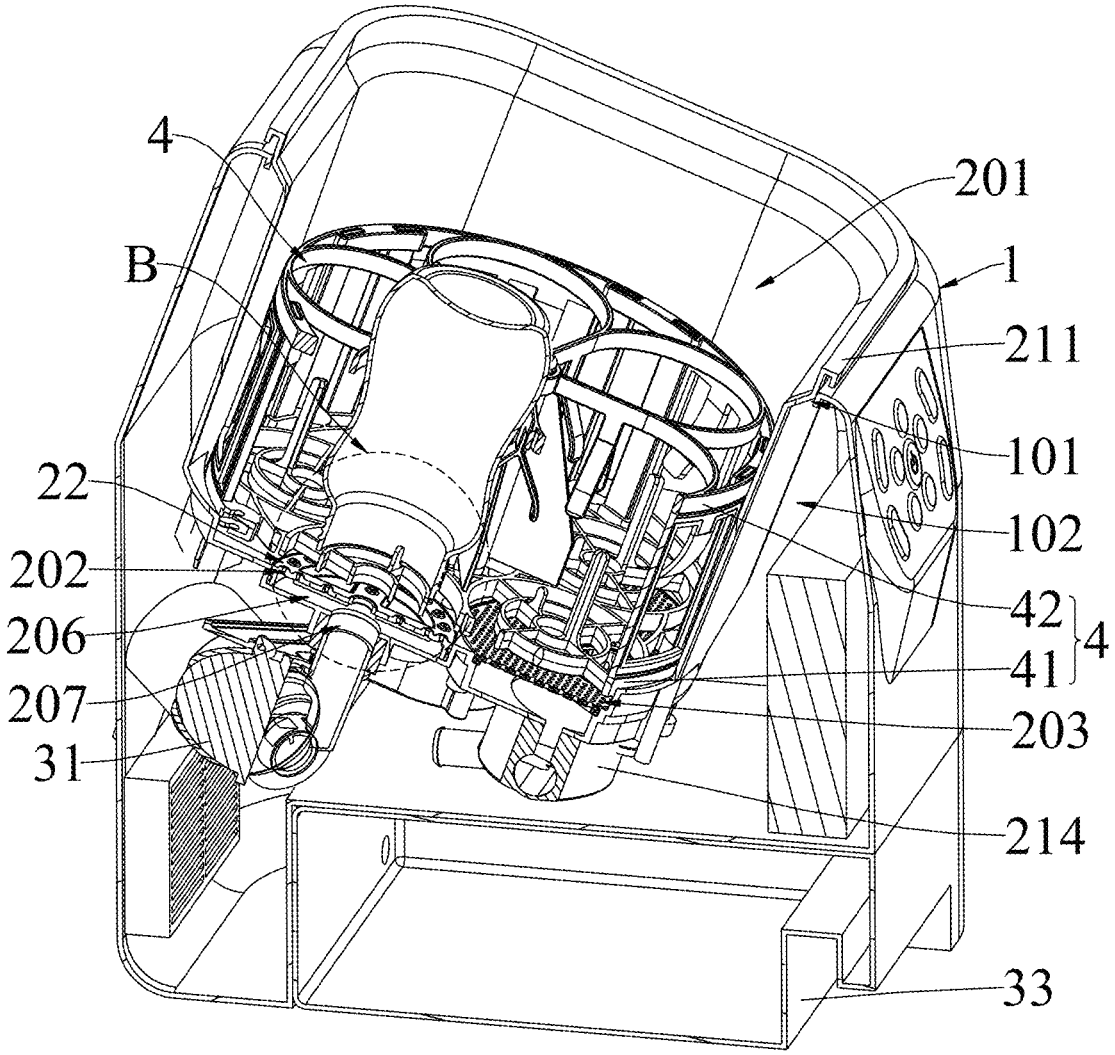
FIG. 3 is a second section diagram of a washing device according to an embodiment.

As shown in FIG. 2 and FIG. 3, besides the features provided by the above embodiment, in this embodiment, it is further specified that: the main machine 1 is provided with a first mounting cavity 102 having a top opening 101, and the included angle between the central axis of the top opening 101 and the vertical direction is an acute angle; and the inner container assembly 2 is detachably arranged in the first mounting cavity 102, and a flange 211 is formed on the top of the inner container assembly 2 and used for abutting against the end surface of the top opening 101. By means of this structure, on one hand, the inner container assembly 2 can be rapidly and conveniently assembled on and disassembled from the main machine 1, and on the other hand, the top opening 101 is obliquely formed in the main machine 1, so that when the inner container assembly 2 abuts against the end surface of the top opening 101 by the flange 21, the inclined arrangement of the inner container assembly 2 can be achieved, and the structure is simple.

Figure 6:
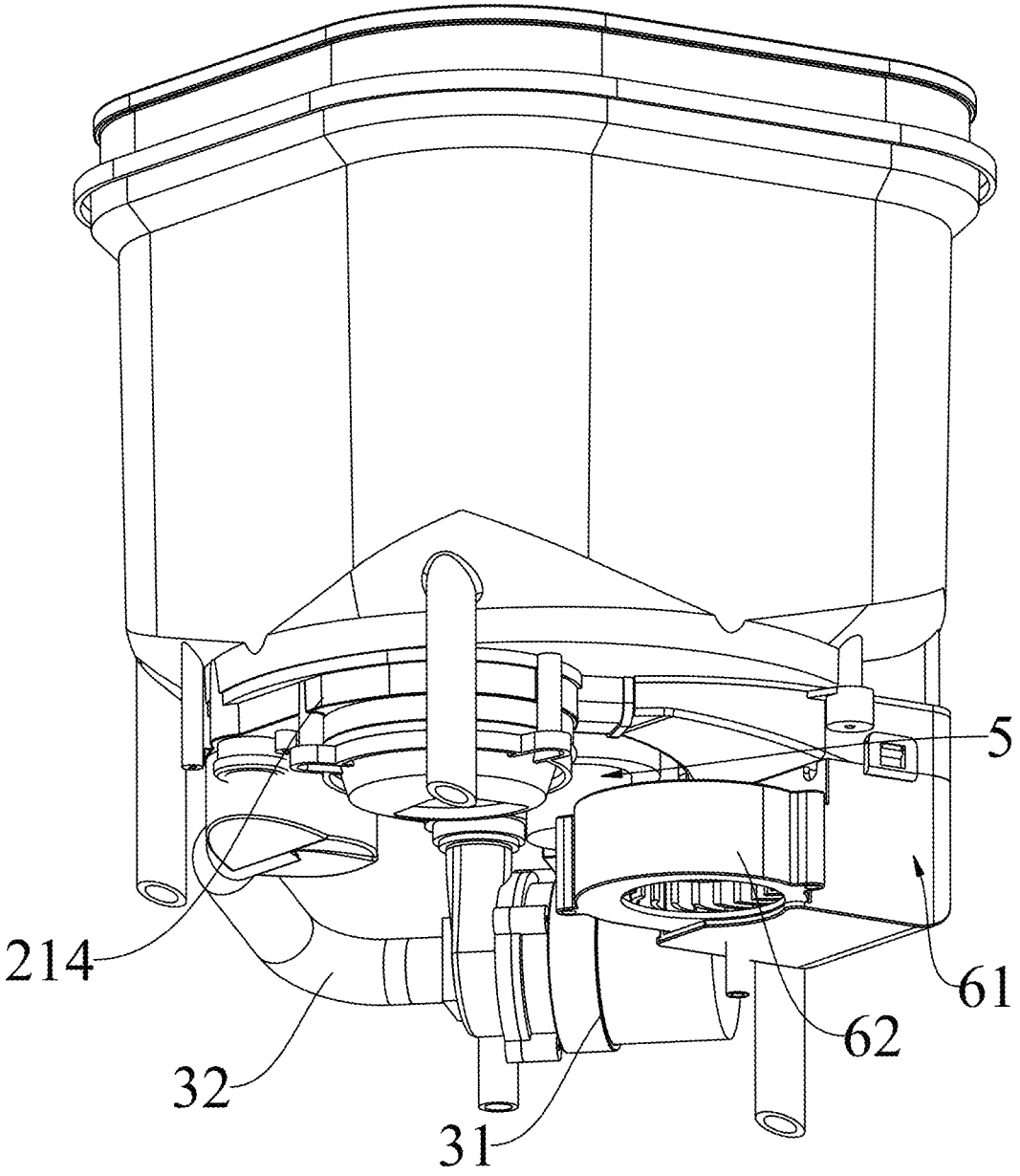
FIG. 6 is a three-dimensional diagram of a local structure of a washing device according to an embodiment.

As shown in FIG. 2 and FIG. 6, besides the features provided by above embodiment, in this embodiment, it is further specified that: the washing device further includes the support assembly 4 and a rotating mechanism 5; the support assembly 4 is movably arranged in the washing cavity 201 and is used for limiting the part to be washed; the output end of the rotating mechanism 5 is in driving connection with the support assembly 4; and the support assembly 4 is configured to drive the part to be washed to rotate relative to the inner container assembly 2 under the driving of the rotating mechanism 5. The rotating mechanism 5 is arranged to drive the support assembly 4 to rotate, and during use, after the plurality of parts to be washed are placed on the support assembly 4 to be fixed, the rotating mechanism 5 can drive the support assembly 4 and the part to be washed to rotate relative to the inner container assembly 2, thus each part to be washed passing through the liquid outlet holes 202 can be sequentially sprayed and cleaned by the cleaning water sprayed through the liquid outlet holes 202, and a waterway structure of the device is simplified while it is guaranteed that all the parts to be washed are fully and effectively cleaned.

Figure 5:
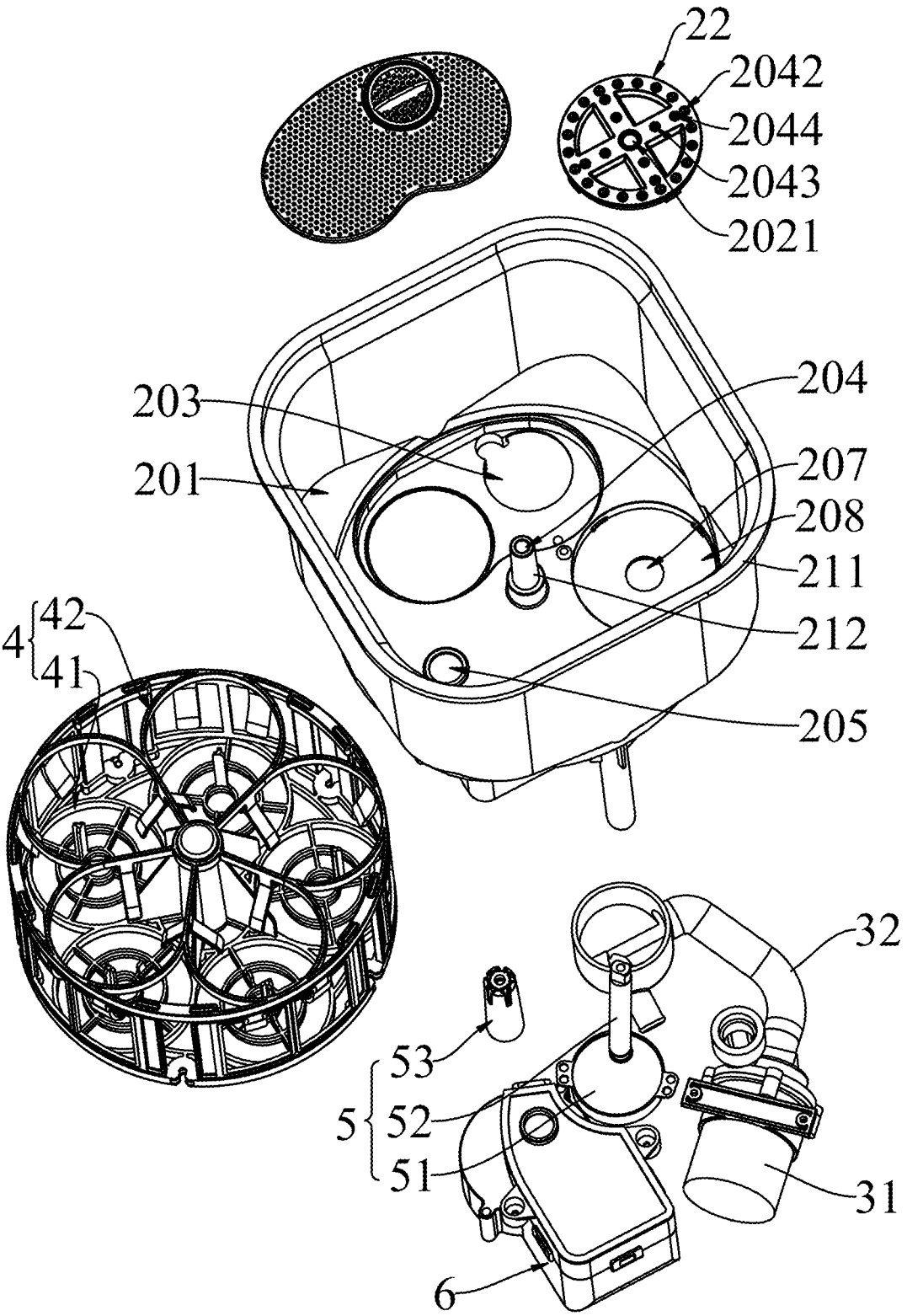
FIG. 5 is a second exploded diagram of a washing device according to an embodiment.
Figure 7:
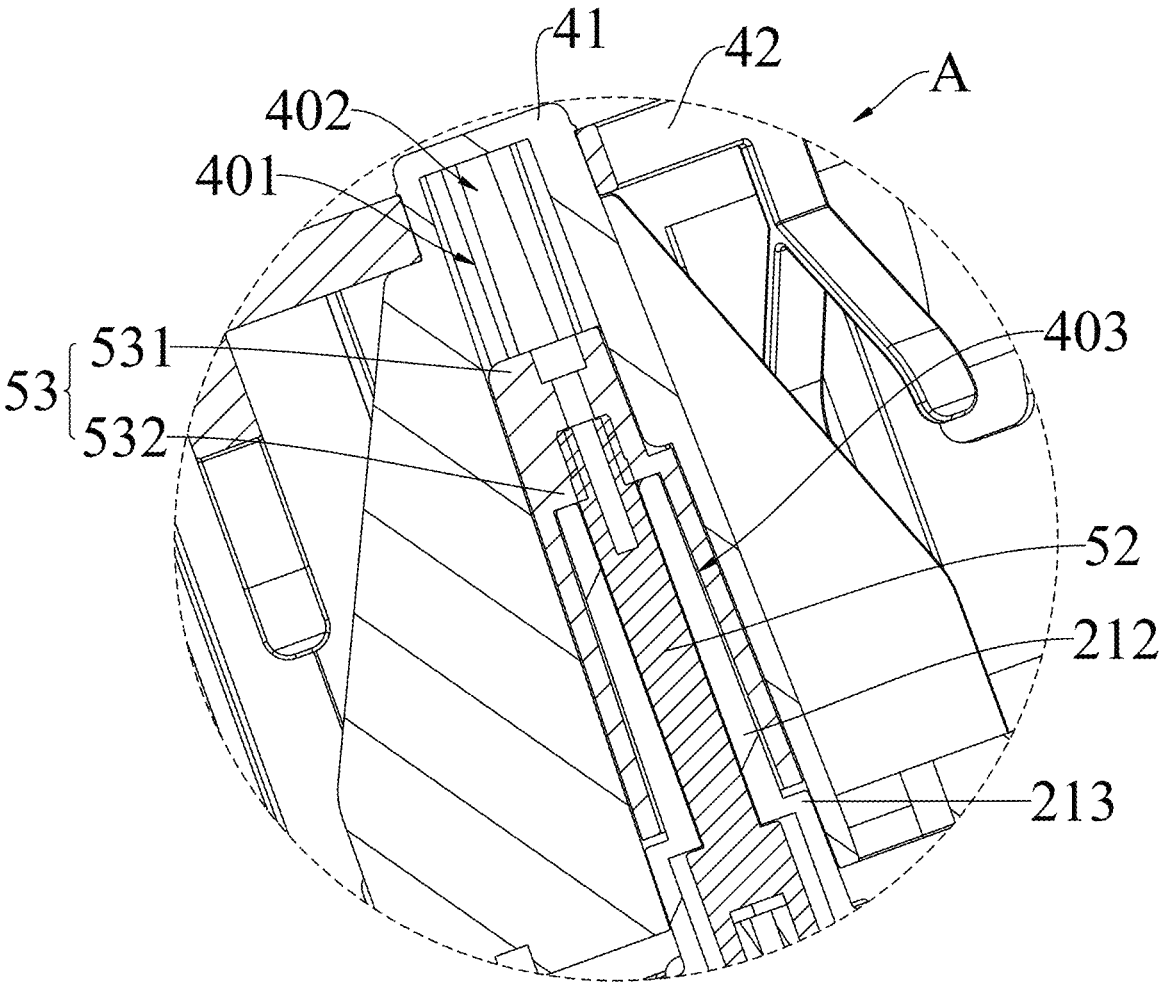
FIG. 7 is an enlarged diagram of an area A in FIG. 2.

As shown in FIG. 2, FIG. 5 and FIG. 7, besides the features provided by the above embodiment, in this embodiment, it is further specified that the support assembly 4 includes a supporting seat 41 and a limiting support 42; the supporting seat 41 is detachably connected to the output end of the rotating mechanism 5 and is used for supporting the part to be washed; and the limiting support 42 is detachably arranged on the supporting seat 41 and is used for limiting and fixing the end, away from the supporting seat 41, of the part to be washed. By means of this structure, the support assembly 4 is composed of the supporting seat 41 and the limiting support 42 which are detachably connected, when a user disassembles the support assembly 4 for cleaning the washing device, the support assembly 4 can be further disassembled, thus food residues at dead corners of the support assembly 4 can be removed conveniently, and dirt accumulation is reduced.

Besides the features provided by the above embodiment, in this embodiment, it is further specified that: the washing device further includes a sensor assembly which is used for acquiring the rotating position information of the support assembly 4 so as to support the rotating mechanism 5 to control the positioning rotation of the support assembly 4. The sensor assembly is used for collecting the rotating position information of the support assembly 4, and the rotating mechanism 5 can flexibly adjust the position of each station on the support assembly 4 relative to the inner container assembly 2 according to the position information, so that the time for adjusting different positions to correspond to the liquid outlet holes 202 for cleaning operation according to the cleaning requirements of different parts to be washed.

As shown in FIG. 5 and FIG. 7, besides the features provided by above embodiment, in this embodiment, it is further specified that: the bottom wall of the washing cavity 201 protrudes to form a mounting portion 212, and the mounting portion 212 is provided with a first mounting hole 204 communicating with the washing cavity 201; the rotating mechanism 5 is arranged in the main machine 1, and the output end of the rotating mechanism 5 extends into the washing cavity 201 through the first mounting hole 204 to be detachably connected to the support assembly 4. By means of this structure, the support assembly 4 is detachably connected to the output end of the rotating mechanism 5, and therefore when cleaning the washing device, the user can easily disassemble the support assembly 4 to fully expose the dead corners in the device, which greatly improves the cleaning effect and the cleaning efficiency; and in addition, the protruded mounting portion 212 is provided with the first mounting hole 204 used for penetrating through the output end of the rotating mechanism 5, thus reducing the risk of water entering the first mounting hole 204, and ensuring the use safety of the rotating mechanism 5.

As shown in FIG. 5 and FIG. 7, besides the features provided by the above embodiment, in this embodiment, it is further specified that: the rotating mechanism 5 includes a driving motor 51, a transmission shaft 52 and a shaft sleeve 53; the shaft sleeve 53 is located in the washing cavity 201 and is rotatably arranged on the mounting portion 212; one end of the transmission shaft 52 penetrates through the first mounting hole 204 to be mounted adaptive to the shaft sleeve 53, and the driving motor 51 is in transmission connection with the other end of the transmission shaft 52 to drive the transmission shaft 52 and the shaft sleeve 53 to rotate relative to the inner container assembly 2; and the support assembly 4 is detachably arranged on the shaft sleeve 53. By means of this structure, the transmission shaft 52 is in transmission connection with the support assembly 4 by the shaft sleeve 53, and in combination with the connection between the shaft sleeve 53 and the mounting portion 212, the mounting portion 212 can directly provide a supporting effect for the support assembly 4, which ensures that the part to be washed can be driven by the rotation of the support assembly 4 to stably rotate relative to the inner container assembly 2 and the liquid outlet hole 202 so as to be fully sprayed and cleaned; and in addition, through the connection between the shaft sleeve 53 and the mounting portion 212, the splashed liquid in the washing cavity 201 can be prevented from leaking through a gap between a transmission rod and the inner wall of the first mounting hole 204 to damage the driving motor 51.

As shown in FIG. 7, besides the features provided by the above embodiment, in this embodiment, it is further specified that: an inserting groove 401 is formed in one of the support assembly 4 and the shaft sleeve 53, and the other one of the support assembly 4 and the shaft sleeve 53 is adaptively inserted into the inserting groove 401. By means of this structure, the support assembly 4 and the shaft sleeve 53 can be quickly assembled without screws, nuts and other accessories, which greatly facilitates the user to conveniently disassemble the support assembly 4 for cleaning the washing device in all directions.

As shown in FIG. 5 and FIG. 7, besides the features provided by the above embodiment, in this embodiment, it is further specified that a key groove 402 is formed in the inner wall of the inserting groove 401, and the support assembly 4 or the shaft sleeve 53 is provided with a clamping key 531 which is mounted adaptive to the key groove 402. By means of this structure, the support assembly 4 and the shaft sleeve 53 are assembled in an inserted mode by the inserting groove 401, and in combination with the adaptive mounting of the clamping key 531 and the key groove 402, the support assembly 4 and the shaft sleeve 53 can be further interlocked, so that the shaft sleeve 53 can accurately transmit torque to the support assembly 4 to achieve synchronous rotation, and the support assembly 4 is prevented from rotating automatically to influence positioning rotation of the user on the support assembly 4.

As shown in FIG. 7, besides the features provided by the above embodiment, in this embodiment, it is further specified that the support assembly 4 is provided with the inserting groove 401, an annular sealing portion 213 is arranged on the peripheral wall of the end, away from the shaft sleeve 53, of the mounting portion 212, and the annular sealing portion 213 is mounted adaptive to an opening of the inserting groove 401. By means of the above structure, after the support assembly 4 and the shaft sleeve 53 are assembled in the inserted mode by the inserting groove 401, the annular sealing portion 213 on the mounting portion 212 can be used for sealing the opening of the inserting groove 401 in a fitting mode, and therefore the liquid in the washing cavity 201 can be prevented from entering the inserting groove 401 and can also be prevented from splashing and flowing into a connecting gap between the mounting portion 212 and the shaft sleeve 53 and/or the transmission shaft 52 to cause leakage.

As shown in FIG. 7, besides the features provided by the above embodiment, in this embodiment, it is further specified that the shaft sleeve 53 is provided with a second mounting hole 403, and the end, away from the driving motor 51, of the mounting portion 212 is mounted adaptive to the second mounting hole 403. By means of the above structure, after the mounting portion 212 enters the second mounting hole 403 and is connected to the inner wall of the second mounting hole 403, the liquid splashing in the washing cavity 201 can be prevented from directly passing through the gap between the transmission rod and the inner wall of the first mounting hole 204 to cause leaking.

As shown in FIG. 7, besides the features provided by the above embodiment, in this embodiment, it is further specified that a limiting step 532 is formed on the inner wall of one end, far away from the motor, of the second mounting hole 403, and the top wall of the mounting portion 212 is propped against the limiting step 532. By means of this structure, the top wall of the mounting portion 212 is propped against the limiting step 532 to limit and support the shaft sleeve 53, so that the shaft sleeve 53 can be stably mounted, and the support assembly 4 is prevented from driving the shaft sleeve 53 to downwards slip to influence the rotation of a rotary support while bearing a heavy part to be washed.

As shown in FIG. 7, besides the features provided by the above embodiment, in this embodiment, it is further specified that the radial length of the second mounting hole 403 gradually decreases in the direction far away from the motor. The tapered second mounting hole 403 can be matched with the adaptive mounting portion 212 to achieve the limiting effect; and when the support assembly 4 bears the heavy part to be washed, the shaft sleeve 53 can be stably mounted without downward slipping.

Figure 4:
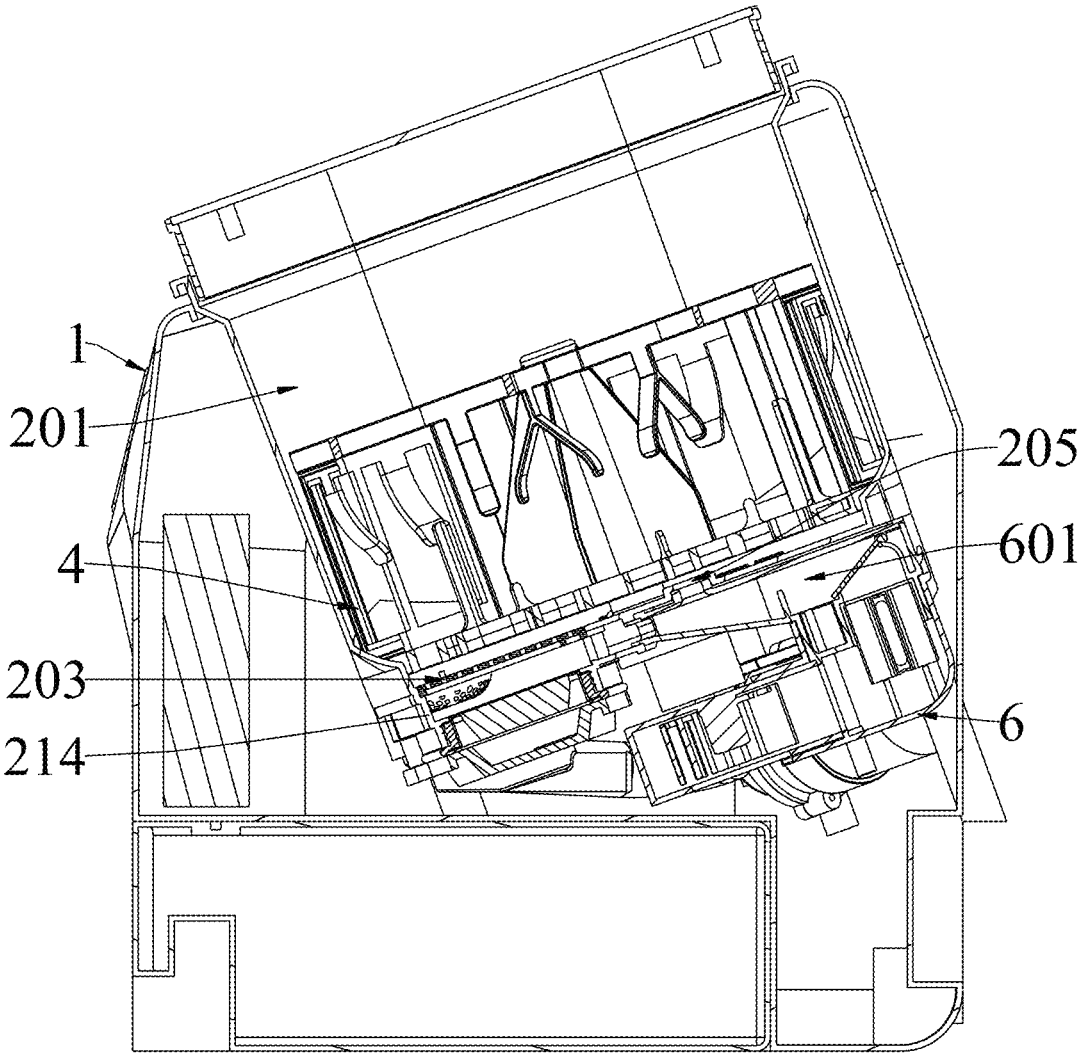
FIG. 4 is a third section diagram of a washing device according to an embodiment.
Figure 8:
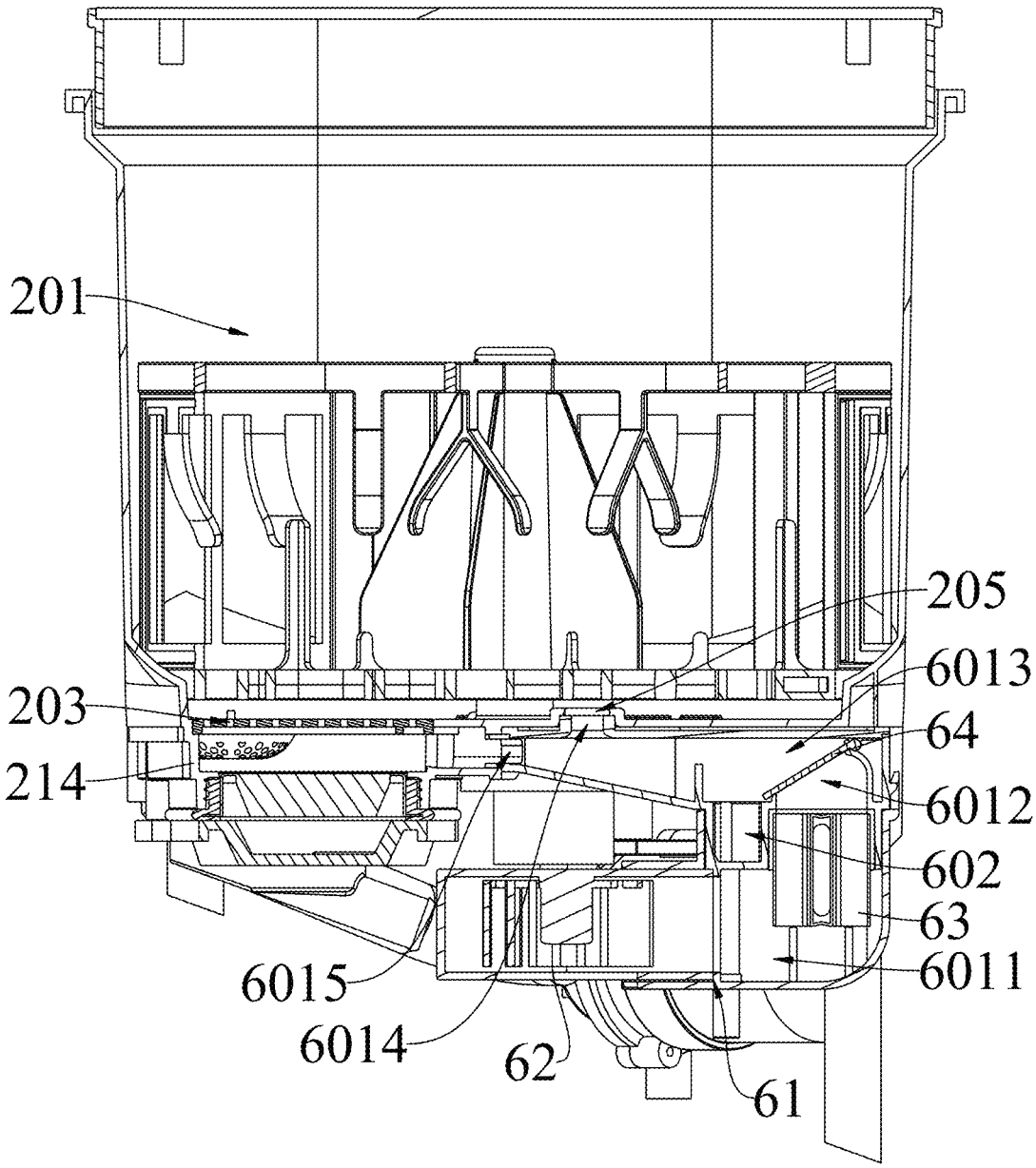
FIG. 8 is a section diagram of a local structure of a washing device according to an embodiment.

As shown in FIG. 4 and FIG. 8, besides the features provided by the above embodiment, in this embodiment, it is further specified that the washing device further includes the support assembly 4 and an air supply module 6; a first air inlet 205 communicating with the washing cavity 201 is formed in the bottom wall of the inner container assembly 2, and the horizontal height of the first air inlet 205 is greater than that of the backflow opening 203; the support assembly 4 is arranged in the washing cavity 201 and located above the first air inlet 205; the air supply module 6 includes an air duct shell 61 and a fan assembly 62; the air duct shell 61 is arranged on the outer side of the inner container assembly 2 and is provided with an air supply channel 601 communicating with the washing cavity 201; and at least part of the fan assembly 62 is located in the air supply channel 601, and the fan assembly 62 is used for driving outside air to enter the air supply channel 601 and then to enter the washing cavity 201 through the first air inlet 205. The first air inlet 205 is further formed in the bottom wall of the inclined inner container assembly 2 and used for inputting airflow; the horizontal height of the first air inlet 205 is set to be greater than that of the backflow opening 203, and therefore, in the washing process, the cleaning water in the washing cavity 201 preferentially flows back to the water pump 31 through the backflow opening 203, thus reducing the possibility of the cleaning water entering the air supply channel 601. After washing, the washed devices such as a feeding bottle are inverted on the support assembly 4 which is of a hollow structure, a bottle opening of the feeding bottle is downward and is opposite to the first air inlet 205, then the fan assembly 62 drives the outside air to flow through the air supply channel 601 of the air duct shell 61 and then to enter the washing cavity 201 by the first air inlet 205, and further the outside air enters the feeding bottle through the bottle opening to drive to quickly exhaust damp and hot air, and therefore the drying effect of the washing device is improved.

Besides the features provided by the above embodiment, in this embodiment, it is further specified that the inner container assembly 2 is provided with a second air inlet which communicates with the washing cavity 201 and the air outlet end of the air supply channel 601, and the fan assembly 62 is used for driving the outside air to enter the air supply channel 601 and then to enter the washing cavity 201 by the second air inlet. By means of this structure, the airflow entering the washing cavity 201 through the second air inlet takes away water vapor on the inner wall of the washing cavity 201 and the outer surface of the part to be washed, thereby ensuring that the inner wall of the washing cavity 201 and objects in the cavity are fully dried.

Besides the features provided by the above embodiment, in this embodiment, it is further specified that the second air inlet is located in the side wall of the inner container assembly 2.

As shown in FIG. 4 and FIG. 8, besides the features provided by the above embodiment, in this embodiment, it is further specified that the backflow opening 203 communicates with the air outlet end of the air supply channel 601, and the fan assembly 62 is used for driving the outside air to enter the air supply channel 601 and then to enter the washing cavity 201 and the washing module 3 through the backflow opening 203. By means of this structure, on one hand, the airflow flowing to the backflow opening 203 from the air supply channel 601 enters the washing cavity 201 to take away the water vapor on the inner wall of the washing cavity 201 and the outer surface of the part to be washed, and on the other hand, the airflow enters the washing module 3 at the same time to dry the water pump 31, the inner wall of a pipeline and the like, thereby avoiding the hygiene risk of bacteria breeding caused by long-term prolonged dampness of the water pump 31 and the pipeline, and being conducive to more durable use.

As shown in FIG. 6 and FIG. 8, besides the features provided by the above embodiment, in this embodiment, it is further specified that a flow guide portion 214 is formed at the bottom of the inner container assembly 2; the flow guide portion 214 is provided with a first liquid passing cavity which communicates with the washing cavity 201 through the backflow opening 203; a first liquid passing opening and a second liquid passing opening which communicate with the first liquid passing cavity are formed in two sides of the flow guide portion 214, respectively; the first liquid passing opening communicates with the water pump 31; and the second liquid passing opening communicates with the output end of the air supply channel 601, and the horizontal height of the second liquid passing opening is greater than that of the first liquid passing opening. By means of this structure, because the horizontal height of the second liquid passing opening is greater than that of the first liquid passing opening, after the cleaning water in the washing cavity 201 enters the first liquid passing cavity through the backflow opening 203, the cleaning water will preferentially enter the water pump 31 or the wastewater tank 33 from the first liquid passing opening at the lower position, and therefore the possibility of the cleaning water entering the air supply channel 601 can be reduced.

Figure 10:
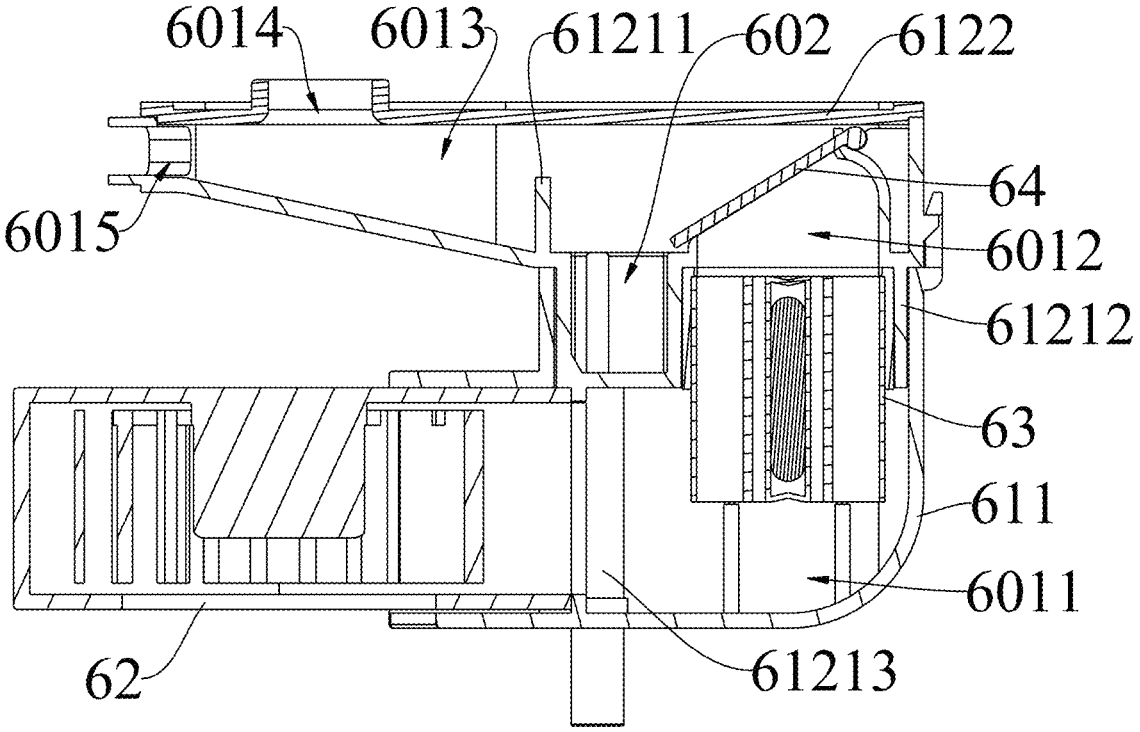
FIG. 10 is a section diagram of an air supply module according to an embodiment.

As shown in FIG. 8 and FIG. 10, besides the features provided by the above embodiment, in this embodiment, it is further specified that the air supply channel 601 includes a second mounting cavity 6011, an air gap 6012 and an air guide cavity 6013 which sequentially communicate; the air outlet end of the air guide cavity 6013 communicates with the washing cavity 201 through the first air inlet 205; at least part of the fan assembly 62 is arranged in the second mounting cavity 6011; and a water collecting tank 602 is arranged in the bottom of the air guide cavity 6013 and is located between the air gap 6012 and the air outlet end of the air guide cavity 6013. By means of this structure, after the cleaning water in the washing cavity 201 enters the air guide cavity 6013 through the first air inlet 205 and/or the backflow opening 203, the water collecting tank 602 can intercept to collect the cleaning water, thus avoiding the cleaning water further flowing to the air gap 6012 to enter the second mounting cavity 6011 to damage electric appliance elements such as the fan assembly 62.

Figure 9:
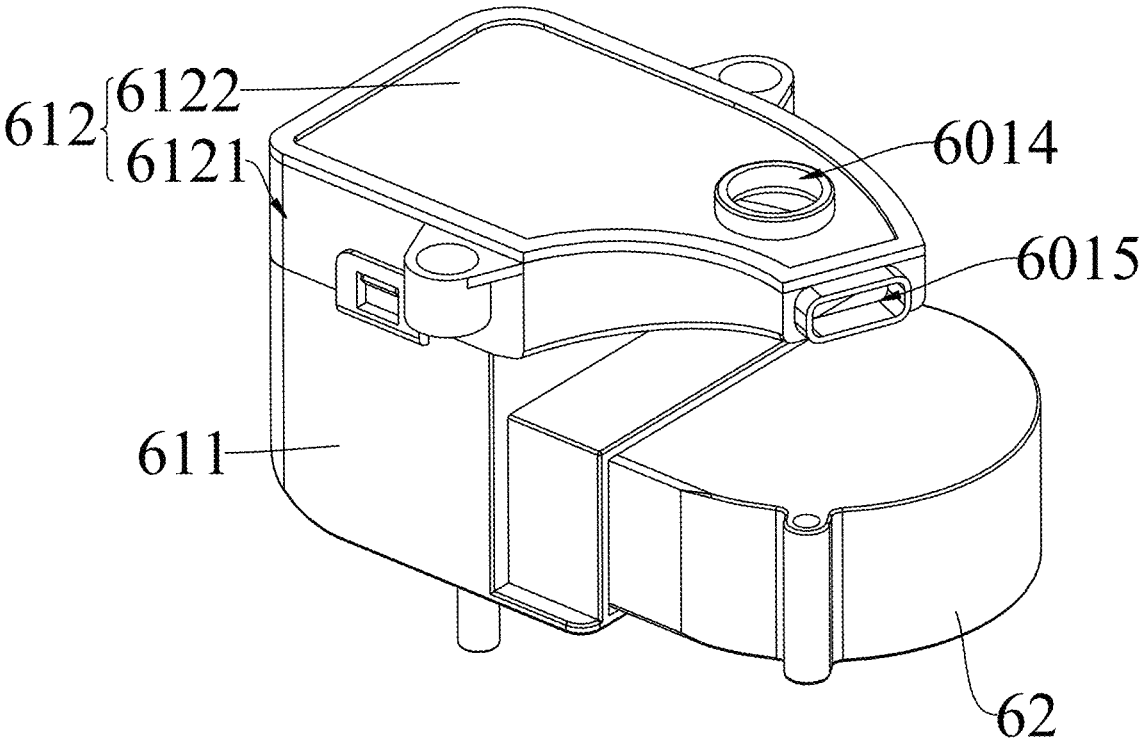
FIG. 9 is a three-dimensional diagram of an air supply module according to an embodiment.

As shown in FIG. 8 to FIG. 10, besides the features provided by the above embodiment, in this embodiment, it is further specified that the air outlet end of the air guide cavity 6013 includes a first air outlet 6014 and a second air outlet 6015; the first air outlet 6014 communicates with the first air inlet 205; and the second air outlet 6015 communicates with the backflow opening 203 or the second air inlet.

Figure 11:
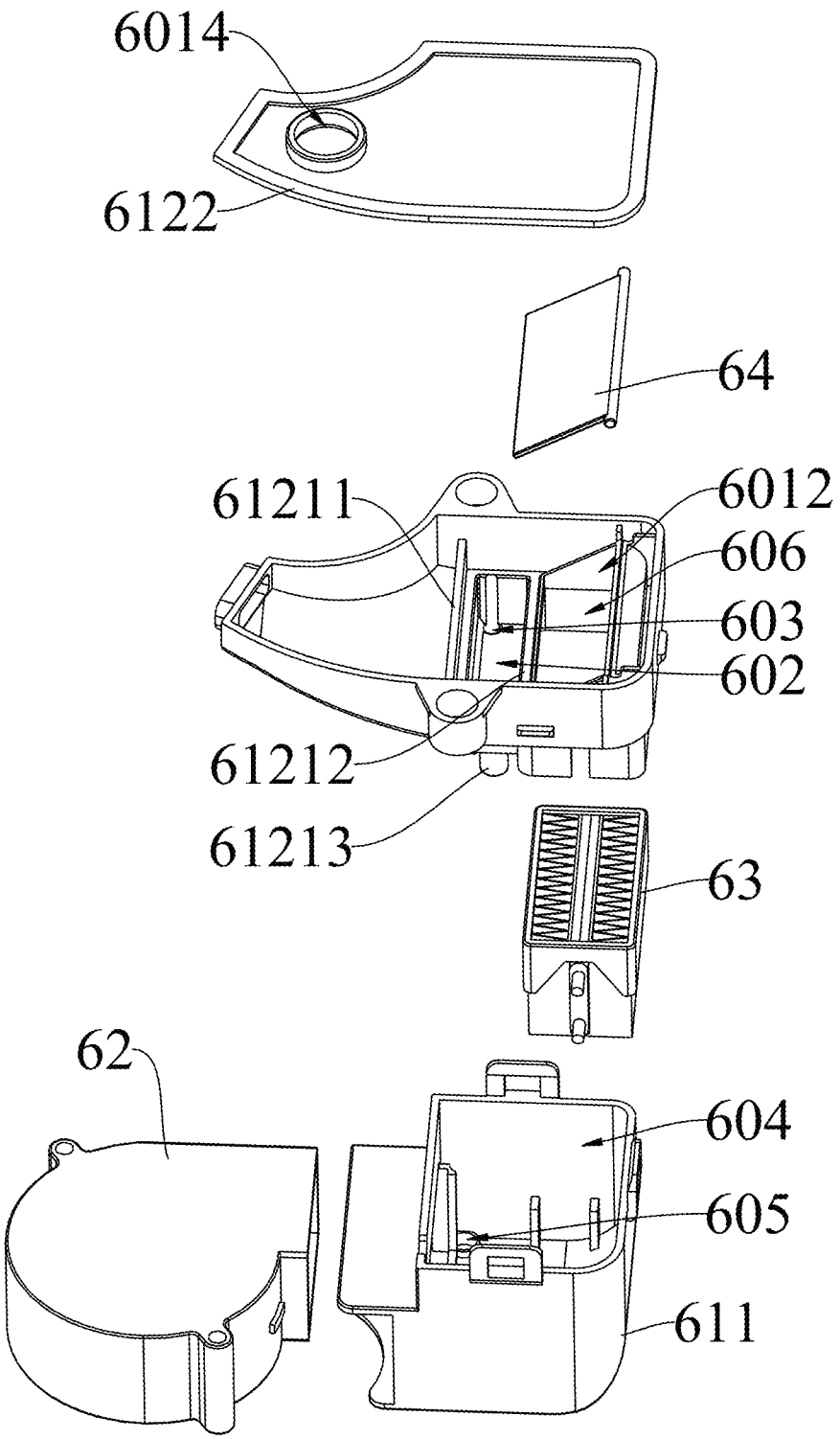
FIG. 11 is an exploded diagram of an air supply module according to an embodiment.

As shown in FIG. 8, FIG. 10 and FIG. 11, besides the features provided by the above embodiment, in this embodiment, it is further specified that a water outlet 603 is formed in the bottom of the water collecting tank 602 and communicates with a drain outlet of the washing module 3/the main machine 1 through the pipeline. By means of this structure, the liquid in the water collecting tank 602 can be conveniently drained through the drain outlet in time, which avoids that too much cleaning water collected by the water collecting tank 602 overflows and flows to the air passing port 6012, and is conducive to reducing the size of the water collecting tank 602, thereby making the structure of the air supply module 6 more compact. Specifically, the water outlet 603 can be in communication with the water pump 31 through the pipeline for recycling again, or in communication with the wastewater tank 33 through the pipeline for collecting in a centralized mode, or directly in communication with the drain outlet of the host 1 for draining to the outside.

As shown in FIG. 8, FIG. 10 and FIG. 11, besides the features provided by the above embodiment, in this embodiment, it is further specified that a water baffle 61211 is arranged on the bottom wall of the air guide cavity 6013 and located between the water collecting tank 602 and the air outlet end of the air guide cavity 6013. After the cleaning water in the washing cavity 201 enters the air guide cavity 6013 through the first air inlet 205 and/or the backflow opening 203, the water baffle can block and buffer the cleaning water, thereby reducing the flowing speed of the cleaning water and avoiding the cleaning water splashing to cause spray flying to the air passing port 6012; and along with increase of the cleaning water in the air guide cavity 6013, the cleaning water flows over the water baffle to fall into the water collecting tank 602.

As shown in FIG. 10 and FIG. 11, besides the features provided by the above embodiment, in this embodiment, it is further specified that the air duct shell 61 includes a first shell 611 and a second shell 612; a mounting opening 604 is formed in the top wall of the first shell 611; a connecting portion 61212 which is mounted adaptive to the mounting opening 604 is formed on the second shell 612; a second mounting cavity 6011 is defined by the connecting portion 61212 and the inner wall of the first shell 611; an air guide cavity 6013 is formed in the second shell 612; and an air gap 6012 is formed in the connecting portion. The second mounting cavity 6011 is defined by the first shell 611 and the second shell 612 which are detachably connected, which facilitates to expose the second mounting cavity 6011 for production personnel to assemble and disassemble electrical apparatus elements such as a heating assembly 63, thereby facilitating repair and maintenance of the air supply module 6. In addition, the first shell 611 and the second shell 612 are respectively provided with the mounting opening 604 and the connecting portion 61212 which fit each other; and in combination with the cooperation of the mounting port 604 and the connecting portion 61212, the first shell 611 and the second shell 612 can be tightly connected, and thus air entering the second mounting cavity 6011 can fully enter the air guide cavity 6013 to avoid leakage.

As shown in FIG. 8, FIG. 10 and FIG. 11, besides the features provided by the above embodiment, in this embodiment, it is further specified that the water collecting tank 602 is located at the connecting portion 61212; a drain pipe 61213 is arranged on the side, facing the first shell 611, of the connecting portion; a limiting hole 605 is formed in the bottom wall of the first shell 611; one end of the drain pipe 61213 communicates with the water collecting tank 602 while the other end thereof penetrates through the limiting hole 605 to extend to the outside of the second mounting cavity 6011 and communicates with the drain outlet of the washing module 3/main machine 1. By means of this structure, on one hand, the liquid in the water collecting tank 602 can be conveniently drained in time by the drain pipe 61213, and on the other hand, the drain pipe 61213 passes through the second mounting cavity 6011 and the limiting hole 605 to extend to the outside, which reduces the exposure of the drain pipe 61213 and makes the structure of the air duct shell 61 more compact and simpler; and moreover, the drain pipe 61213 and the limiting hole 605 can be matched to realize a limiting effect, so that the second shell 612 can be more easily located on the first shell 611, which makes the mounting more stable.

As shown in FIG. 8, FIG. 10 and FIG. 11, besides the features provided by the above embodiment, in this embodiment, it is further specified that the air supply module 6 further includes the heating assembly 63 which is arranged in the second mounting cavity 6011 and is used for heating air entering the air supply channel 601. After the air in the air supply channel 601 is heated by the heating assembly 63, the drying efficiency of the washing device can be greatly improved, and a certain sterilization and disinfection effect can be achieved.

As shown in FIG. 8, FIG. 10 and FIG. 11, besides the features provided by the above embodiment, in this embodiment, it is further specified that a first mounting groove 606 is formed in the side, facing the second mounting cavity 6011, of the connecting portion; the air gap 6012 is formed in the bottom wall of the first mounting groove 606; and the heating assembly 63 is mounted adaptive to the first mounting groove 606. By means of this structure, the first mounting groove 606 facilitates positioning and mounting of the heating assembly 63, thus improving the mounting efficiency; and moreover, when the air in the second mounting cavity 6011 flows to the air guide cavity 6013 through the air gap 6012, it can be ensured that the air can make full contact with the heating assembly 63, thereby improving the heating efficiency.

As shown in FIG. 9 and FIG. 10, besides the features provided by the above embodiment, in this embodiment, it is further specified that the side, away from the first shell 611, of the second shell 612 is connected to the outer bottom wall of an inner container, and the second shell 612 is provided with a first air outlet 6014 and a second air outlet 6015.

As shown in FIG. 8, FIG. 10 and FIG. 11, besides the features provided by the above embodiment, in this embodiment, it is further specified that the air supply module 6 further includes a rotary valve 64; the rotary valve 64 is rotatably arranged in the air duct shell 61 and has at least an on position and an off position; when the rotary valve 64 is at the on position, the air gap 6012 is opened to connect the air supply channel 601; when the rotary valve 64 is at the off position, the air gap 6012 is closed to disconnect the air supply channel 601; and the rotary valve 64 can be pushed by the airflow generated by the fan assembly 62 so as to be switched to the on position from the off position. The rotary valve 64 is arranged in the air duct and used for opening or closing the air gap 6012, and the rotary valve 64 is rotatably connected to the air duct shell 61; the airflow generated by the fan assembly 62 in working can blow open the rotary valve 64, so as to connect the air supply channel 601; when the fan assembly 62 is closed, the airflow disappears, the rotary valve 64 resets by gravity to block the airflow channel, and at the moment, the rotary valve 64 can perform a blocking effect to further prevent the cleaning water in the washing cavity 201 from entering the air guide cavity 6013 to collide with the inner wall of the air guide cavity 6013 and generate water spray flying to the air gap 6012, as well as preventing the cleaning water from entering the second mounting cavity 6011 to damage electrical apparatus elements such as the heating assembly 63.

As shown in FIG. 8 and FIG. 10, besides the features provided by the above embodiment, in this embodiment, it is further specified that when the rotary valve 64 is at the off position, one end of the rotary valve 64 is rotatably connected to the air duct shell 61, and the other end of the rotary valve 64 inclines downwards and extends to be above the water collecting tank 602. By means of this structure, the rotary valve 64 is in an inclined state when at the off position, and therefore the cleaning water splashing onto the rotary valve 64 can slide into the water collecting tank 602 along the top wall of the rotary valve 64 by gravity.

As shown in FIG. 10 and FIG. 11, besides the features provided by the above embodiment, in this embodiment, it is further specified that the second shell 612 includes a shell body 6121 and a cover body 6122; the cover body 6122 is detachably arranged on the shell body 6121; a shaft hole is defined by a connecting cover and the shell body 6121; and the rotary valve 64 is rotatably connected to the first shell 611 through the cooperation of the rotating shaft and the shaft hole. The shaft hole is defined by the shell body 6121 and the cover body 6122 which are detachably connected, which makes the mounting of the rotary valve 64 convenient and fast.

As shown in FIG. 9 and FIG. 10, besides the features provided by the above embodiment, in this embodiment, it is further specified that the cover plate is provided with the first air outlet 6014.

As shown in FIG. 9 and FIG. 10, besides the features provided by the above embodiment, in this embodiment, it is further specified that the air guide cavity 6013 and the second air outlet 6015 are defined by the cover plate and the shell body 6121.

Figure 12:
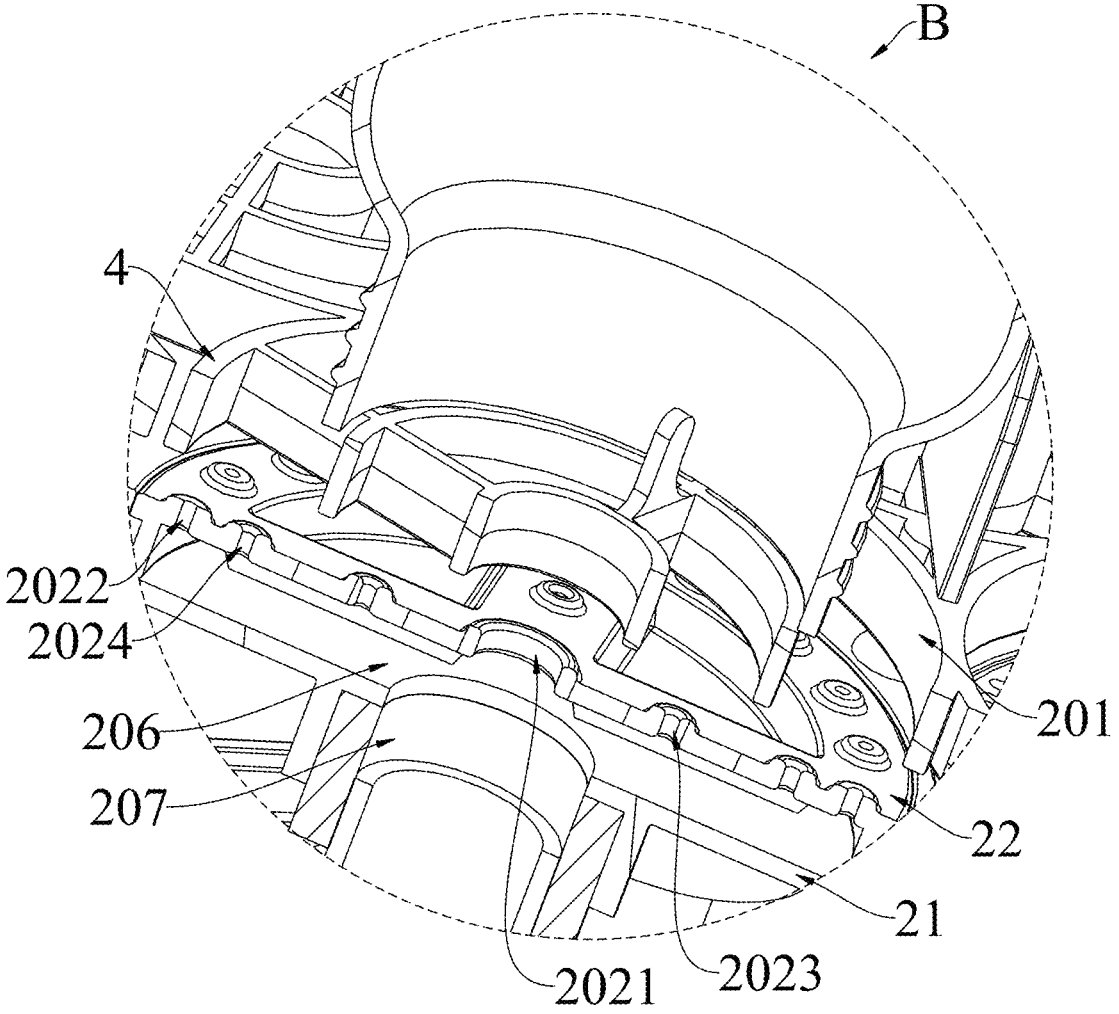
FIG. 12 is an enlarged diagram of an area B in FIG. 3.

As shown in FIG. 3, FIG. 5 and FIG. 12, besides the features provided by the above embodiment, in this embodiment, it is further specified that a pressurizing portion is formed at the bottom of the inner container assembly 2 and is provided with a second liquid passing cavity 206; a liquid inlet hole 207 is formed in one side of the second liquid passing cavity 206, and a plurality of liquid outlet holes 202 are formed in the other side of the second liquid passing cavity 206; the diameter of the plurality of liquid outlet holes 202 is smaller than that of the liquid inlet hole 207; and the output end of the water pump 31, the liquid inlet hole 207, the second liquid passing cavity 206, the plurality of liquid outlet holes 202 and the washing cavity 201 are sequentially communicate. The pressurizing portion is formed on the inner container assembly 2 and used for guiding high-pressure water outputted by the water pump 31 to the washing cavity 201 to spray to flush the part to be washed, in which, the pressurizing portion is provided with the liquid inlet hole 207, the second liquid passing cavity 206 and the plurality of liquid outlet holes 202; and the diameter of the plurality of liquid outlet holes 202 is smaller than that of the liquid inlet hole 207, so that on one hand, the water outputted by the water pump 31 can be better guided to each liquid outlet hole 202 by the pressurizing portion so as to increase the washing area, and on the other hand, when the high-pressure cleaning water outputted by the water pump 31 flows to the liquid outlet holes 202 from the liquid inlet hole 207 to be sprayed out, the sectional area suddenly reduces, the flow speed increases, and thus the water pressure is increased; and through the cooperative use of the water pump 31 and the pressurizing portion, the cleaning water has higher impact force to wash the surface of the part to be washed under the condition that it is not needed to increase the power of the water pump 31, so that the cleaning effect of the washing device is effectively guaranteed.

As shown in FIG. 3, FIG. 5 and FIG. 12, besides the features provided by the above embodiment, in this embodiment, it is further specified that each liquid outlet hole 202 includes a first liquid outlet hole 2021 and a plurality of second liquid outlet holes 2022; and the plurality of second liquid outlet holes 2022 are arranged at intervals around the central axis of the first liquid outlet hole 2021, and the diameter of the first liquid outlet hole 2021 is larger than or equal to that of the second liquid outlet holes 2022. By means of this structure, the first liquid outlet holes 2021 can be aligned with an opening of an inner cavity of the inverted part to be washed on the support assembly 4, so that the cleaning water sprayed from the first liquid outlet holes 2021 can clean the inner wall of the part to be washed, and moreover, the cleaning water sprayed by the plurality of second liquid outlet holes 2022 can be matched to wash the outer peripheral wall of the part to be washed, thereby making sure that the part to be washed is fully cleaned.

As shown in FIG. 3, FIG. 5 and FIG. 12, besides the features provided by the above embodiment, in this embodiment, it is further specified that each liquid outlet hole 202 further includes a plurality of third liquid outlet holes 2023 which are arranged at intervals around the central axes of the first liquid outlet holes 2021; and the plurality of third liquid outlet holes 2023 are matched with the first liquid outlet holes 2021 to spray the cleaning water to the inner wall of the part to be washed in the washing cavity (201). By arranging the plurality of third liquid outlet holes 2023, the consumption and the spraying coverage area of the cleaning water entering the inner cavity of the part to be washed from the liquid outlet holes 202 of the pressurizing portion can be increased, and therefore the washing efficiency can be further improved on the premise that the water pressure is prevented from being reduced due to the increase in the diameter of the first liquid outlet holes 2021.

As shown in FIG. 3, FIG. 5 and FIG. 12, besides the features provided by the above embodiment, in this embodiment, it is further specified that each liquid outlet hole 202 further includes a plurality of fourth liquid outlet holes 2024 which are arranged at intervals around the central axes of the first liquid outlet holes 2021; and the plurality of fourth liquid outlet holes 2024 are matched with the second liquid outlet holes 2022 to spray the cleaning water to the outer wall of the part to be washed in the washing cavity (201). By arranging the plurality of fourth liquid outlet holes 2024, the consumption of the cleaning water sprayed to the outer wall of the part to be washed by the liquid outlet holes 202 of the pressurizing portion can be increased, so that on one hand, the cleaning time can be decreased, and on the other hand, for the part to be washed with the radial size changed, the outer wall can be better covered with the cleaning water that is directly sprayed.

Besides the features provided by the above embodiment, in this embodiment, it is further specified that the diameter of the first liquid outlet holes 2021 and/or the diameter of the second liquid outlet holes 2022 gradually increase in the direction away from the liquid inlet hole 207. By means of this structure, the cleaning water sprayed by the liquid outlet hole 202 can be diffused to a certain extent so as to enlarge the spraying area.

Besides the features provided by the above embodiment, in this embodiment, it is further specified that the diameter of the first liquid outlet holes 2021 is 7.0-9.0 mm.

Besides the features provided by the above embodiment, in this embodiment, it is further specified that the diameter of the second liquid outlet holes 2022 is 1.0-2.0 mm.

Besides the features provided by the above embodiment, in this embodiment, it is further specified that the diameter of the third liquid outlet hole 2023 and/or the diameter of the fourth liquid outlet holes 2024 gradually increase in the direction away from the liquid inlet hole 207.

Besides the features provided by the above embodiment, in this embodiment, it is further specified that the diameter of the third liquid outlet holes 2023 and/or the diameter of the fourth liquid outlet holes 2024 are/is 1.0-2.0 mm.

As shown in FIG. 5 and FIG. 12, besides the features provided by the above embodiment, in this embodiment, it is further specified that the inner container assembly 2 includes an inner container body 21 and a water spray cover 22; the water spray cover 22 is detachably arranged on the bottom wall of the inner container body 21; a second liquid passing cavity 206 is defined by the water spray cover 22 and the inner container body 21; the liquid inlet hole 207 is formed in the bottom wall of the inner container body 21; and a plurality of liquid outlet holes 202 are formed in the water spray cover 22. By means of the inner container body 21 and the water spray cover 22 which are detachably connected, the user can conveniently disassemble the water spray cover 22 to expose the internal structure of the pressurizing portion for complete cleaning, thereby avoiding dirt accumulation and sanitation dead corners.

Figure 13:
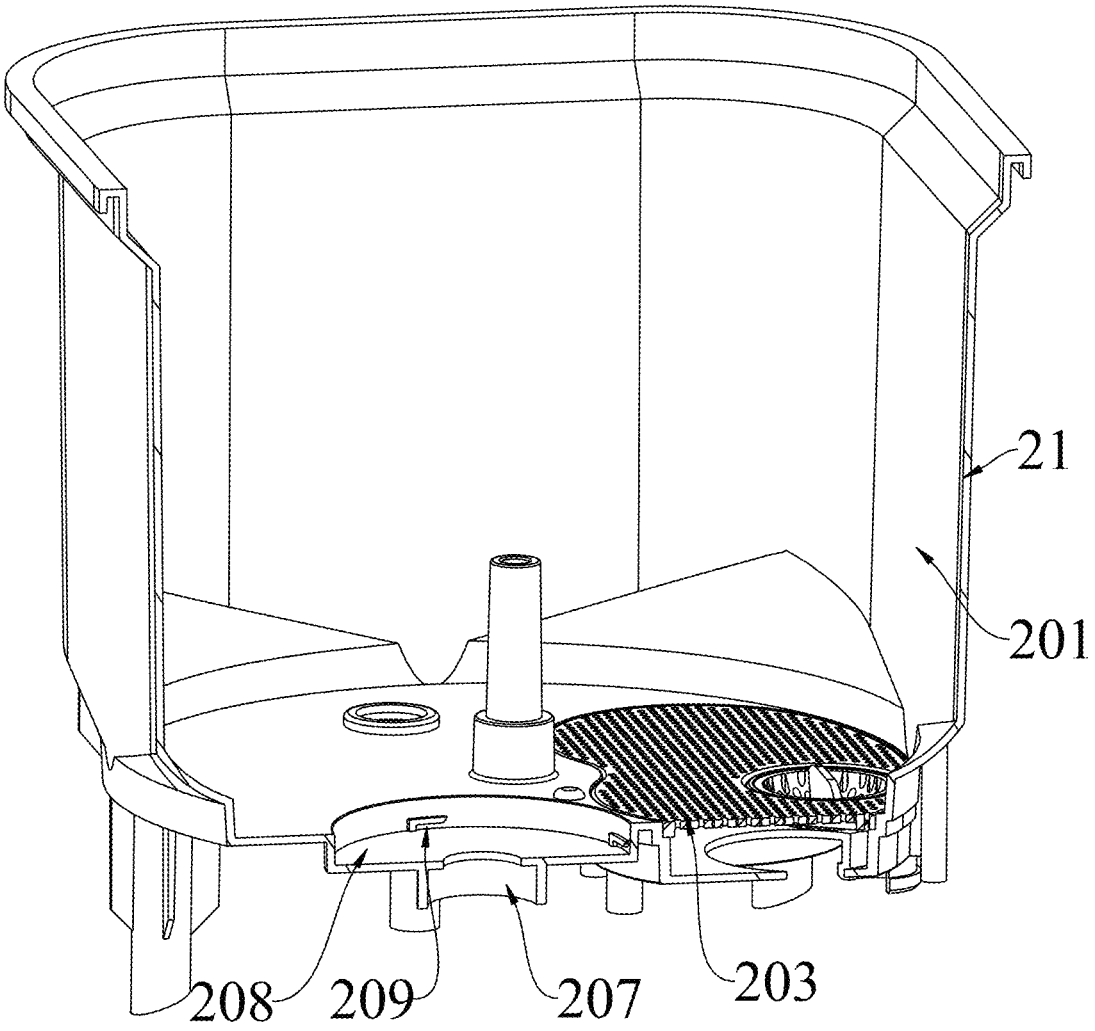
FIG. 13 is a section diagram of an inner container assembly according to an embodiment.
Figure 14:
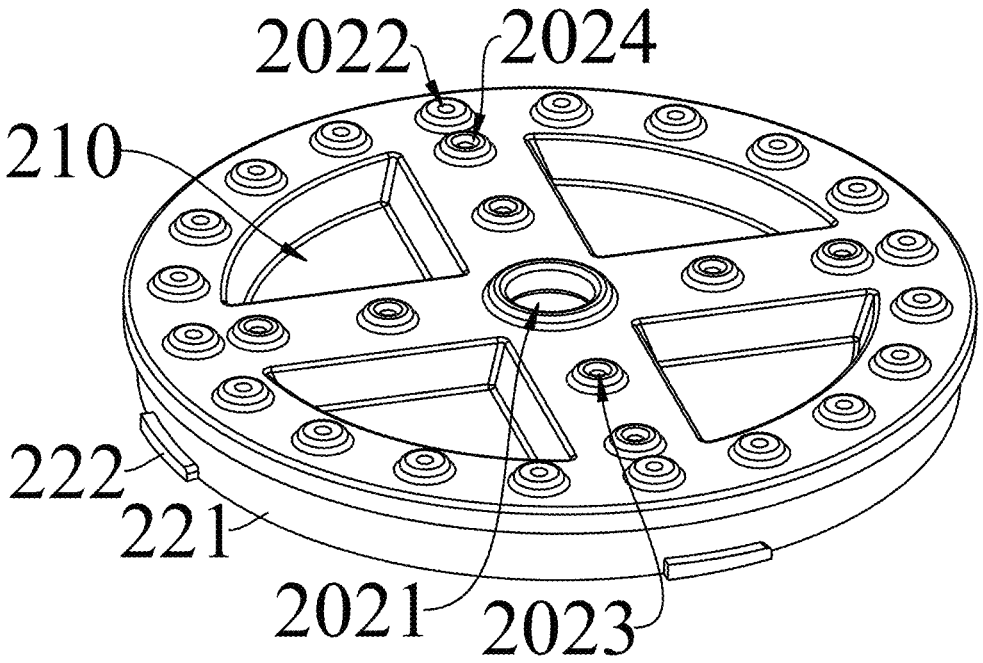
FIG. 14 is a three-dimensional diagram of a water spray cover according to an embodiment.

As shown in FIG. 13 and FIG. 14, besides the features provided by the above embodiment, in this embodiment, it is further specified that a second mounting groove 208 is formed in the bottom wall of the inner container body 21; the liquid inlet hole 207 is formed in the bottom wall of the second mounting groove 208; a limiting groove 209 is formed in the inner side wall of the second mounting groove 208 and extends in the circumferential direction of the second mounting groove 208; a mounting ring 221 fitting the second mounting groove 208 is formed at the bottom of the water spray cover 22; a bump 222 is arranged on the outer wall of the mounting ring 221; the water spray cover 22 is movably arranged in the second mounting groove 208 and is configured to rotate around the central axis of the limiting groove 209 relative to the inner container body 21 under the driving of external force and has at least a locking position and a releasing position; when the water spray cover 22 is at the locking position, the bump 222 is mounted adaptive to the limiting groove 209 to limit the water spray cover 22 to move upwards away from the second mounting groove 208; and when the water spray cover 22 is at the releasing position, the bump 222 is separated from the limiting groove 209 to make the water spray cover 22 move upwards away from the second mounting groove 208. The second mounting groove 208 and the mounting ring 221 which fit each other are formed on the bottom wall of the inner container body 21 and the water spray cover 22 correspondingly, on the one hand, the second mounting groove 208 and the mounting ring 221 are matched to realize the positioning effect, thus the mounting efficiency of the water spray cover 22 is greatly improved, and on the other hand, the sealing connection between the water spray cover 22 and the inner container body 21 can be enhanced to ensure that the liquid entering the second liquid passing cavity 206 through the liquid inlet hole 207 can fully flow to the liquid outlet holes 202 so as to be sprayed to the washing cavity 201. Moreover, the bump 222 capable of being matched with the limiting groove 209 in the second mounting groove 208 is arranged on the outer wall of the mounting ring 221, the water spray cover 22 can be locked and released when rotating relative to the limiting groove 209 under operation of the user, and operation is easy, stable and reliable. Specifically, after the water spray cover 22 is mounted in the second mounting groove 208, the water spray cover 22 is rotated forwards to the locking position, the bump 222 will be mounted adaptive to the limiting groove 209 and the inner wall of the limiting groove 209 abuts against the top wall of the bump 222, thus the water spray cover 22 can be prevented from being separated from the limiting groove 209 under the impact of water pressure, and it is ensured that the cleaning water can be stably sprayed; and when it is needed to disassemble the water spray cover 22, the water spray cover 22 is rotated reversely to the releasing position, in addition, the bump 222 is separated from the limiting groove 209, the limiting effect is achieved, and then the water spray cover 22 can be easily taken out.

As shown in FIG. 14, besides the features provided by the above embodiment, in this embodiment, it is further specified that the top wall of the water spray cover 22 is sunken downwards to form at least two receding grooves 210; and the at least receding grooves 210 are arranged at intervals around the central axis of the water spray cover 22 and are matched for operation to drive the water spray cover 22 to move relative to the inner container body 21. By means of this structure, the receding grooves 210 can facilitate the user to stretch in with fingers, and the receding grooves 210 can provide acting points for the user to operate, and therefore the rotating operation on the water spray cover 22 is more flexible and convenient; and the receding grooves 210 are sunken, so that an operating portion is prevented from protruding to influence the assembling of the support assembly 4.

As shown in FIG. 2, besides the features provided by the above embodiment, in this embodiment, it is further specified that the washing module 3 further includes the wastewater tank 33 and a blow-off pipeline; the wastewater tank 33 is arranged on the main machine 1; the washing cavity 201 or the water pump 31 communicates with the wastewater tank 33 through the blow-off pipeline; and a switch valve is arranged on the blow-off pipeline. By means of this structure, when cleaning is finished and it is needed to drain wastewater in the washing cavity 201 and/or the water pump 31, the switch valve can be opened for water draining; and the waste water is collected into the wastewater tank 33. It is to be noted that the switch valve is used for connecting or disconnecting the blow-off pipeline; when the switch valve is on, the blow-off pipeline is connected; and when the switch valve is off, the blow-off pipeline is disconnected.

As shown in FIG. 2, besides the features provided by the above embodiment, in this embodiment, it is further specified that the washing module 3 further includes a clean water tank 34 which is arranged on the main machine 1 and is used for providing cleaning water for the washing device.

Various technical features of the foregoing embodiments may be randomly combined. To make description concise, not all possible combinations of the technical features in the foregoing embodiments are described. However, the combinations of these technical features shall be considered as falling within the scope recorded by this description provided that no conflict exists.

The foregoing embodiments only describe several implementations of the present application, which are described specifically and in detail, but cannot be construed as a limitation to the patent scope of the present application. It should be noted that for a person of ordinary skill in the art, several transformations and improvements can be made without departing from the idea of the present application. These transformations and improvements belong to the protection scope of the present application. Therefore, the protection scope of the patent of the present application shall be subject to the appended claims.

What is claimed is:

1. A washing device, comprising:

a main machine;

an inner container assembly which is arranged on the main machine and provided with a washing cavity, the inner container assembly being provided with liquid outlet holes and a backflow opening which communicate with the washing cavity, the bottom wall of the washing cavity inclining relative to the horizontal direction, the backflow opening being located in the side with lower height of the bottom wall of the washing cavity, and the horizontal height of the liquid outlet holes being greater than that of the backflow opening; and a washing module comprising a water pump and a circulation pipeline, an input end of the water pump communicating with the backflow opening by the circulation pipeline while an output end thereof communicating with the washing cavity through the liquid outlet holes so as to spray cleaning water to a part to be washed in the washing cavity; and a support assembly and an air supply module, wherein a first air inlet communicating with the washing cavity is formed in the bottom wall of the inner container assembly, and the horizontal height of the first air inlet is greater than that of the backflow opening; the support assembly is arranged in the washing cavity and located above the first air inlet; the air supply module comprises an air duct shell and a fan assembly; the air duct shell is arranged on the outer side of the inner container assembly and is provided with an air supply channel communicating with the washing cavity; at least part of the fan assembly is located in the air supply channel; and the fan assembly is used for driving outside air to enter the air supply channel and then to enter the washing cavity through the first air inlet; and a pressurizing portion is formed at the bottom of the inner container assembly and is provided with a second liquid passing cavity; a liquid inlet hole is formed in one side of the second liquid passing cavity, and a plurality of liquid outlet holes are formed in the other side of the second liquid passing cavity; the diameter of the plurality of liquid outlet holes is smaller than that of the liquid inlet hole; and the output end of the water pump, the liquid inlet hole, the second liquid passing cavity, the plurality of liquid outlet holes and the washing cavity sequentially communicate; and each liquid outlet hole comprises a first liquid outlet hole and a plurality of second liquid outlet holes; and the plurality of second liquid outlet holes are arranged at intervals around the central axis of the first liquid outlet hole, and the diameter of the first liquid outlet hole is larger than or equal to that of the second liquid outlet holes.

2. The washing device according to claim 1, further comprising:

a support assembly used for limiting the part to be washed, wherein the inner container assembly and the support assembly are obliquely arranged in the main machine in the same direction; the liquid outlet holes are located in the bottom wall of the inner container assembly, and an included angle between the central axes of the liquid outlet holes and the vertical direction is an acute angle; and/or the main machine is provided with a first mounting cavity having a top opening, the included angle between the central axis of the top opening and the vertical direction is an acute angle, the inner container assembly is detachably arranged in the first mounting cavity, and a flange (211) is formed on the top of the inner container assembly and used for abutting against the end surface of the top opening.

3. The washing device according to claim 1, further comprising the support assembly and a rotating mechanism, wherein the support assembly is movably arranged in the washing cavity and is used for limiting the part to be washed, the output end of the rotating mechanism is in driving connection with the support assembly, and the support assembly is configured to drive the part to be washed to rotate relative to the inner container assembly under the driving of the rotating mechanism.

4. The washing device according to claim 3, wherein the bottom wall of the washing cavity protrudes to form a mounting portion, and the mounting portion is provided with a first mounting hole communicating with the washing cavity; and the rotating mechanism is arranged in the main machine, and the output end of the rotating mechanism extends into the washing cavity through the first mounting hole to be detachably connected to the support assembly.

5. The washing device according to claim 4, wherein the rotating mechanism comprises a driving motor, a transmission shaft and a shaft sleeve; the shaft sleeve is located in the washing cavity and is rotatably arranged on the mounting portion; one end of the transmission shaft penetrates through the first mounting hole to be mounted adaptive to the shaft sleeve, the driving motor is in transmission connection with the other end of the transmission shaft to drive the transmission shaft and the shaft sleeve to rotate relative to the inner container assembly; and the support assembly is detachably arranged on the shaft sleeve.

6. The washing device according to claim 1, wherein the inner container assembly is provided with a second air inlet which communicates with the washing cavity and the air outlet end of the air supply channel, and the fan assembly is used for driving outside air to enter the air supply channel and then to enter the washing cavity through the second air inlet; or the backflow opening communicates with the air outlet end of the air supply channel, and the fan assembly is used for driving outside air to enter the air supply channel and then to enter the washing cavity and the washing module through the backflow opening.

7. The washing device according to claim 1, wherein the air supply channel comprises a second mounting cavity, an air gap and an air guide cavity which sequentially communicate; an air outlet end of the air guide cavity communicates with the washing cavity through the first air inlet; at least part of the fan assembly is arranged in the second mounting cavity; and a water collecting tank is arranged at the bottom of the air guide cavity, and is located between the air gap and the air outlet end of the air guide cavity.

8. The washing device according to claim 7, wherein a water outlet is formed in the bottom of the water collecting tank and communicates with a drain outlet of the washing module/the main machine by the pipeline; and/or a water baffle is arranged on the bottom wall of the air guide cavity and is located between the water collecting tank and the air outlet end of the air guide cavity; and/or the air duct shell comprises a first shell and a second shell; a mounting opening is formed in the top wall of the first shell; a connecting portion which is mounted adaptive to the mounting opening is formed on the second shell; a second mounting cavity is defined by the connecting portion and the inner wall of the first shell; the air guide cavity is arranged in the second shell; the air gap is formed in the connecting portion; and/or the air supply module further comprises a heating assembly which is arranged in the second mounting cavity and is used for heating air entering the air supply channel; and/or the air supply module further comprises a rotary valve which is rotatably arranged in the air duct shell and has at least an on position and an off position; when the rotary valve is at the on position, the air gap is opened to connect the air supply channel; when the rotary valve is at the off position, the air gap is closed to disconnect the air supply channel; and the rotary valve can be pushed by the airflow generated by the fan assembly so as to be switched to the on position from the off position.

9. The washing device according to claim 1, wherein each liquid outlet hole further comprises a plurality of third liquid outlet holes which are arranged at intervals around the central axis of the first liquid outlet holes; and the plurality of third liquid outlet holes are matched with the first liquid outlet holes to spray the cleaning water to the inner wall of the part to be washed in the washing cavity; and/or each liquid outlet hole further comprises a plurality of fourth liquid outlet holes which are arranged at intervals around the central axis of the first liquid outlet holes; and the plurality of fourth liquid outlet holes are matched with the second liquid outlet holes to spray the cleaning water to the outer wall of the part to be washed in the washing cavity; and/or the diameter of the first liquid outlet holes and/or the diameter of the second liquid outlet holes gradually increase in the direction away from the liquid inlet hole; and/or the diameter of the first liquid outlet holes is 7.0-9.0 mm; and/or the diameter of the second liquid outlet holes is 1.0-2.0 mm.

10. The washing device according to claim 1, wherein the inner container assembly comprises an inner container body and a water spray cover; the water spray cover is detachably arranged on the bottom wall of the inner container body; a second liquid passing cavity is defined by the water spray cover and the inner container body; the liquid inlet hole is formed in the bottom wall of the inner container body; and the plurality of liquid outlet holes are formed in the water spray cover.

11. The washing device according to claim 10, wherein a second mounting groove is formed in the bottom wall of the inner container body; the liquid inlet hole is formed in the bottom wall of the second mounting groove; a limiting groove is formed in the inner side wall of the second mounting groove and extends in the circumferential direction of the second mounting groove; a mounting ring fitting the second mounting groove is formed at the bottom of the water spray cover, a bump is arranged on the outer wall of the mounting ring; the water spray cover is movably arranged in the second mounting groove; the water spray cover is configured to be driven by external force to rotate around the central axis of the limiting groove relative to the inner container body and has at least a locking position and a releasing position; when the water spray cover is at the locking position, the bump is mounted adaptive to the limiting groove to limit the water spray cover to move upwards away from the second mounting groove; and when the water spray cover is at the releasing position, the bump is separated from the limiting groove to make the water spray cover move upwards away from the second mounting groove.

12. The washing device according to claim 1, wherein the washing module further comprises a wastewater tank and a blow-off pipeline; the wastewater tank is arranged on the main machine; the washing cavity or the water pump communicates with the wastewater tank by the blow-off pipeline; a switch valve is arranged on the blow-off pipeline; and/or the washing module further comprises a clean water tank which is arranged on the main machine and is used for providing cleaning water for the washing device.

* * * * *